US011181309B2

(12) United States Patent
Shi et al.

(10) Patent No.: US 11,181,309 B2
(45) Date of Patent: Nov. 23, 2021

(54) DIRECT COOLING ICE MAKER

(71) Applicant: Electrolux Home Products, Inc., Charlotte, NC (US)

(72) Inventors: Zhuochen Shi, Clemson, SC (US); Thomas W. McCollough, Piedmont, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 16/681,931

(22) Filed: Nov. 13, 2019

(65) Prior Publication Data

US 2020/0080759 A1 Mar. 12, 2020

Related U.S. Application Data

(63) Continuation-in-part of application No. 15/852,022, filed on Dec. 22, 2017, now Pat. No. 10,539,354.

(51) Int. Cl.
*F25C 1/04* (2018.01)
*F25D 11/02* (2006.01)
(Continued)

(52) U.S. Cl.
CPC ..... *F25C 1/04* (2013.01); *F25C 1/24* (2013.01); *F25C 1/25* (2018.01); *F25C 5/08* (2013.01);
(Continued)

(58) Field of Classification Search
CPC .... F25C 1/04; F25C 5/182; F25C 5/22; F25C 1/24; F25D 11/02; F25D 11/022
See application file for complete search history.

(56) References Cited

U.S. PATENT DOCUMENTS 2,403,406 A 7/1946 Smith
2,846,854 A 2/1954 Galin
(Continued)

FOREIGN PATENT DOCUMENTS

AU 2013203181 5/2014
EP 2341303 7/2011
(Continued)

OTHER PUBLICATIONS

Partial International Search Report for PCT/US2018/065636, dated Apr. 1, 2019, 2 pages.
(Continued)

*Primary Examiner* — Kun Kai Ma
(74) *Attorney, Agent, or Firm* — Pearne & Gordon LLP

(57) ABSTRACT

A refrigeration appliance includes a fresh food compartment for storing food items in a refrigerated environment having a target temperature above 0° C., a freezer compartment for storing food items in a sub-freezing environment having a target temperature below 0° C., a system evaporator for providing a cooling effect to at least one of the fresh food compartment and the freezer compartment, and an ice tray assembly disposed within the fresh food compartment for freezing water into ice pieces. The ice tray assembly includes an ice mold with an upper surface comprising a plurality of cavities formed therein for the ice pieces, a heater disposed on the ice mold and an ice maker refrigerant tube abutting at least one lateral side surface of the ice mold and cooling the ice mold to a temperature below 0° C. via thermal conduction and a cover having a water fill cup integrated into the cover and an outlet aligned with an inlet of the ice mold.

9 Claims, 24 Drawing Sheets

(51) Int. Cl.

| | |
|---|---|
| ***F25C 1/24*** | (2018.01) |
| ***F25C 1/25*** | (2018.01) |
| ***F25C 5/182*** | (2018.01) |
| ***F25C 5/20*** | (2018.01) |
| ***F25C 5/08*** | (2006.01) |

(52) U.S. Cl.
CPC ..... *F25C 5/182* (2013.01); *F25C 5/22* (2018.01); *F25D 11/022* (2013.01); *F25C 2305/022* (2013.01); *F25C 2700/06* (2013.01)

(56) References Cited

U.S. PATENT DOCUMENTS

| | | | | |
|---|---|---|---|---|
| 2,743,588 | A | 5/1956 | Dreier | |
| 2,778,198 | A * | 1/1957 | Heath | F25C 1/04 62/137 |
| 3,192,726 | A | 7/1965 | Newton | |
| 3,623,336 | A * | 11/1971 | Fox | F25C 5/187 62/233 |
| 3,871,242 | A * | 3/1975 | Linstromberg | F25C 1/04 74/421 A |
| 8,104,729 | B2 | 1/2012 | Walke et al. | |
| 8,181,471 | B2 | 5/2012 | Heger et al. | |
| 8,601,829 | B2 | 12/2013 | Heger et al. | |
| 8,616,018 | B2 | 12/2013 | Jeong et al. | |
| 8,875,536 | B2 | 11/2014 | Jeong et al. | |
| 8,950,197 | B2 | 2/2015 | Bortoletto et al. | |
| 8,973,391 | B2 | 3/2015 | Lee | |
| 8,973,392 | B2 | 3/2015 | Jeong et al. | |
| 9,074,804 | B2 | 7/2015 | Yoon | |
| 9,080,799 | B2 | 7/2015 | Hong et al. | |
| 9,109,829 | B2 | 8/2015 | Lim et al. | |
| 9,261,303 | B2 | 2/2016 | Jeong et al. | |
| 9,383,131 | B2 | 7/2016 | Jeong et al. | |
| 9,448,003 | B2 | 9/2016 | Shin et al. | |
| 9,482,458 | B2 | 11/2016 | Jeong et al. | |
| 9,492,898 | B2 | 11/2016 | An et al. | |
| 9,506,680 | B2 | 11/2016 | Jeong et al. | |
| 9,534,821 | B2 | 1/2017 | Yoon et al. | |
| 9,568,234 | B2 | 2/2017 | Jeong et al. | |
| 9,604,324 | B2 | 3/2017 | An et al. | |
| 9,618,258 | B2 | 4/2017 | Shin et al. | |
| 9,625,200 | B2 | 4/2017 | Gu et al. | |
| 9,689,600 | B2 | 6/2017 | Jeong et al. | |
| 9,719,710 | B2 | 8/2017 | Vang | |
| 9,791,198 | B2 | 10/2017 | Jeong et al. | |
| 2005/0072167 | A1 * | 4/2005 | Oh | F25C 1/04 62/137 |
| 2006/0242971 | A1 * | 11/2006 | Cole | F25C 1/04 62/66 |
| 2006/0266067 | A1 * | 11/2006 | Anderson | F25C 1/04 62/340 |
| 2009/0044559 | A1 | 2/2009 | Heger et al. | |
| 2009/0113918 | A1 | 5/2009 | Heger et al. | |
| 2009/0193824 | A1 | 8/2009 | Heger et al. | |
| 2009/0272141 | A1 | 11/2009 | Heger et al. | |
| 2009/0277191 | A1 | 11/2009 | Heger et al. | |
| 2009/0293508 | A1 | 12/2009 | Rafalovich | |
| 2009/0308095 | A1 | 12/2009 | Koog | |
| 2010/0011786 | A1 | 1/2010 | Shin et al. | |
| 2010/0139295 | A1 | 6/2010 | Zuccolo et al. | |
| 2010/0326118 | A1 | 12/2010 | Jeong et al. | |
| 2011/0000248 | A1 | 1/2011 | Jeong et al. | |
| 2011/0185760 | A1 | 4/2011 | Suh | |
| 2011/0162392 | A1 | 7/2011 | Lim et al. | |
| 2011/0162404 | A1 | 7/2011 | Shin et al. | |
| 2011/0162405 | A1 | 7/2011 | Jeong et al. | |
| 2011/0162406 | A1 | 7/2011 | Shin et al. | |
| 2012/0042681 | A1 | 2/2012 | McDaniel | |
| 2012/0279240 | A1 * | 11/2012 | Jeong | F25C 1/04 62/129 |
| 2012/0318003 | A1 | 12/2012 | Kim et al. | |
| 2013/0167569 | A1 | 7/2013 | Lee | |
| 2013/0167574 | A1 | 7/2013 | Yoon | |
| 2013/0167575 | A1 | 7/2013 | Hong et al. | |
| 2013/0227983 | A1 | 9/2013 | Jeong et al. | |
| 2013/0263621 | A1 | 10/2013 | An et al. | |
| 2013/0264929 | A1 | 10/2013 | An et al. | |
| 2013/0298405 | A1 | 11/2013 | An et al. | |
| 2014/0083127 | A1 | 3/2014 | Jeong et al. | |
| 2015/0013374 | A1 | 1/2015 | Jeong et al. | |
| 2015/0068224 | A1 * | 3/2015 | Subera | F25C 5/187 62/66 |
| 2015/0135760 | A1 | 5/2015 | Jeong et al. | |
| 2015/0323238 | A1 | 11/2015 | Lim | |
| 2016/0245574 | A1 | 8/2016 | Jeong et al. | |
| 2016/0370050 | A1 | 12/2016 | Park | |
| 2016/0370053 | A1 | 12/2016 | Yang | |
| 2016/0370054 | A1 | 12/2016 | Yang | |
| 2016/0370055 | A1 | 12/2016 | Yang | |
| 2016/0370057 | A1 | 12/2016 | Yang | |
| 2016/0370058 | A1 | 12/2016 | Yang | |
| 2016/0370067 | A1 | 12/2016 | Park | |
| 2016/0370096 | A1 | 12/2016 | Yang | |
| 2017/0089629 | A1 | 3/2017 | Ji et al. | |
| 2017/0292746 | A1 | 10/2017 | Yang | |
| 2017/0292750 | A1 | 10/2017 | Yang | |
| 2017/0307273 | A1 | 10/2017 | Lee | |
| 2019/0011166 | A1 * | 1/2019 | Bertolini | F25D 17/065 |

FOREIGN PATENT DOCUMENTS

| | | |
|---|---|---|
| EP | 2610564 | 7/2013 |
| JP | 2010114115 | 5/2010 |
| WO | 2010099439 | 9/2010 |
| WO | 2017120153 | 7/2017 |

OTHER PUBLICATIONS

International Search Report for PCT/2020/050370, dated Feb. 2021, 2 pages.

* cited by examiner

DIRECT COOLING ICE MAKER

CROSS-REFERENCE TO RELATED APPLICATIONS

The present application is a continuation-in-part of U.S. application Ser. No. 15/852,022, filed on Dec. 22, 2017.

FIELD OF THE INVENTION

This application relates generally to an ice maker for a refrigeration appliance, and more particularly, to a refrigeration appliance including a direct cooling ice maker.

BACKGROUND OF THE INVENTION

Conventional refrigeration appliances, such as domestic refrigerators, typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C., such as between 0.25° C. and 4.5° C. and the freezer compartments at temperatures below 0° C., such as between 0° C. and −20° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment may be accessed without exposing the other compartment to the ambient air.

Such conventional refrigerators are often provided with a unit for making ice pieces, commonly referred to as "ice cubes" despite the non-cubical shape of many such ice pieces. These ice making units normally are located in the freezer compartments of the refrigerators and manufacture ice by convection, i.e., by circulating cold air over water in an ice tray to freeze the water into ice cubes. Storage bins for storing the frozen ice pieces are also often provided adjacent to the ice making units. The ice pieces can be dispensed from the storage bins through a dispensing port in the door that closes the freezer to the ambient air. The dispensing of the ice usually occurs by means of an ice delivery mechanism that extends between the storage bin and the dispensing port in the freezer compartment door.

However, for refrigerators such as the so-called "bottom mount" refrigerator, which includes a freezer compartment disposed vertically beneath a fresh food compartment, placing the ice maker within the freezer compartment is impractical. Users would be required to retrieve frozen ice pieces from a location close to the floor on which the refrigerator is resting. And providing an ice dispenser located at a convenient height, such as on an access door to the fresh food compartment, would require an elaborate conveyor system to transport frozen ice pieces from the freezer compartment to the dispenser on the access door to the fresh food compartment. Thus, ice makers are commonly included in the fresh food compartment of bottom mount refrigerators, which creates many challenges in making and storing ice within a compartment that is typically maintained above the freezing temperature of water.

There is provided an ice maker including an evaporator coil in direct contact with an ice tray of the ice maker for cooling the ice tray.

BRIEF SUMMARY OF THE INVENTION

In accordance with one aspect, there is provided a refrigeration appliance including a fresh food compartment for storing food items in a refrigerated environment having a target temperature above 0° C., a freezer compartment for storing food items in a sub-freezing environment having a target temperature below 0° C., a system evaporator for providing a cooling effect to at least one of the fresh food compartment and the freezer compartment; and an ice maker disposed within the fresh food compartment for freezing water into ice pieces. The ice maker includes an ice mold with an upper surface comprising a plurality of cavities formed therein for the ice pieces, a heater disposed on the ice mold and an ice maker refrigerant tube abutting at least one lateral side surface of the ice mold and cooling the ice mold to a temperature below 0° C. via thermal conduction.

The ice maker refrigerant tube of the ice maker may include a first leg and a second leg abutting opposite lateral side surfaces of the ice mold.

The refrigeration appliance may also include a retention clip that is secured to the ice mold and which applies a retaining force against the ice maker refrigerant tube to thereby bias the ice maker refrigerant tube into abutment with the lateral side surface.

The ice maker refrigerant tube of the refrigeration appliance may include a portion that extends away from ice mold and includes a plurality of cooling fins thereon. A fan may be adapted to convey air across the plurality of cooling fins to thereby provide a cooling airflow throughout the ice maker.

The refrigeration appliance may further include a water fill cup formed integrally with the ice mold as a monolithic body. The ice mold and water fill cup may both include a metal material.

The refrigeration appliance may further include an ice box evaporator disposed within the ice maker and configured for supplying cooling air to an ice bin of the ice maker, wherein the ice box evaporator is connected to an outlet of the ice maker refrigerant tube. A centrifugal fan may convey air from the ice bin of the ice maker, over the ice box evaporator and back to the ice bin.

In accordance with another aspect, there is provided a refrigeration appliance including a fresh food compartment for storing food items in a refrigerated environment having a target temperature above 0° C., a freezer compartment for storing food items in a sub-freezing environment having a target temperature below 0° C., a refrigeration system comprising a system evaporator for providing a cooling effect to at least one of the fresh food compartment and the freezer compartment; and an ice maker disposed within the fresh food compartment for freezing water into ice pieces. The ice maker includes an ice mold with an upper surface comprising a plurality of cavities formed therein for the ice pieces, a heater disposed on the ice mold and at least one passage extending through the ice mold adjacent a lateral side surface of the ice mold for conveying a refrigerant there through and cooling the ice mold to a temperature below 0° C. via thermal conduction.

The refrigeration appliance according to this aspect may include a refrigerant tube that is disposed in the at least one passage and has an outer diameter that is substantially equivalent to a diameter of the at least one passage. The ice mold may be over-molded around the refrigerant tube so that the refrigerant tube is thereby encapsulated within the ice mold.

The refrigeration appliance may include a water fill cup formed together with the ice mold as a monolithic body. The ice mold and the water fill cup may both include a metal material.

The refrigeration appliance may include an ice box evaporator disposed within the ice maker and configured for supplying cooling air to an ice bin of the ice maker, wherein the ice box evaporator is connected to an outlet of the at least one passage in the ice mold.

In accordance with yet another aspect, there is provided a refrigeration appliance including a fresh food compartment for storing food items in a refrigerated environment having a target temperature above 0° C., a freezer compartment for storing food items in a sub-freezing environment having a target temperature below 0° C., a system evaporator for providing a cooling effect to at least one of the fresh food compartment and the freezer compartment, an ice maker disposed within the fresh food compartment for freezing water into ice pieces, and a valve. The ice maker includes an ice mold with an upper surface comprising a plurality of cavities formed therein for the ice pieces. An ice maker refrigerant tube cools the ice mold to a temperature below 0° C. via thermal conduction. The valve includes an inlet, a first outlet connected to an inlet of the ice maker refrigerant tube; and a second outlet connected to a bypass line around the ice maker refrigerant tube. The inlet of the valve is connected to the first outlet of the valve when the valve is in a first position such that a refrigerant flows through the ice maker refrigerant tube and the system evaporator, in that order. The inlet of the valve is connected to the second outlet of the valve when the valve is in the second position such that the refrigerant flows through the bypass line and the system evaporator, in that order.

In the refrigeration appliance, an ice box evaporator disposed in the bypass line wherein when the valve is in the first position the refrigerant flows only through the ice maker refrigerant tube and the system evaporator, in that order and when the valve is in the second position the refrigerant flows only through the ice box evaporator and the system evaporator, in that order.

In the refrigeration appliance, an ice box evaporator connected to an outlet of the ice maker refrigerant tube and the bypass line wherein when the valve is in the first position the refrigerant flows only through the ice maker refrigerant tube, the ice box evaporator and the system evaporator, in that order and when the valve is in the second position the refrigerant flows only through the ice box evaporator and the system evaporator, in that order.

The ice maker refrigerant tube of the refrigeration appliance may abut at least one lateral side surface of the ice mold.

The ice mold of the refrigerant appliance may include at least one passage extending through the ice mold adjacent a lateral side surface of the ice mold for conveying a refrigerant there through.

In accordance with still another embodiment, there is provided a refrigeration appliance that includes a fresh food compartment for storing food items in a refrigerated environment having a target temperature above 0° C., a freezer compartment for storing food items in a sub-freezing environment having a target temperature below 0° C., a system evaporator for providing a cooling effect to at least one of the fresh food compartment and the freezer compartment and an ice tray assembly disposed within the fresh food compartment for freezing water into ice pieces. The ice tray assembly includes an ice mold with an upper surface having a plurality of cavities formed therein for the ice pieces. A heater is disposed on the ice mold. An ice maker refrigerant tube abuts at least one lateral side surface of the ice mold and cools the ice mold to a temperature below 0° C. via thermal conduction. A cover is provided that includes a water fill cup integrated into the cover and an outlet aligned with an inlet of the ice mold.

In the foregoing refrigerator appliance, the cover and the ice mold may be configured to capture a support bearing for an ice ejector therebetween wherein the support bearing is part of an ice stripper of the ice tray assembly.

The foregoing refrigerator appliance may include a sensor for detecting an angular position of the ice ejector.

Further the sensor in the foregoing refrigerator appliance may be configured to detect an angular position of a feature of the ice ejector.

In the foregoing refrigerator appliance, the feature may be a contoured shape formed on a distal end of the ice ejector.

The refrigerator appliance may include a bail arm attached to a gear box of the ice tray assembly.

The bail arm in the foregoing refrigerator appliance may be L-shaped with a first leg attached to the gear box and a second leg extending from the first leg. The second leg may include a plurality of spaced-apart reinforcing ribs.

In the foregoing refrigerator appliance, the bail arm may be pivotable between an upper position and a lower position wherein the second leg of the bail arm is positioned underneath the ice mold when the bail arm is in the upper position.

In the foregoing refrigerator, the first leg is offset from the second leg relative to a pivot axis of the bail arm.

In accordance with another embodiment, there is provided a refrigeration appliance that includes a fresh food compartment for storing food items in a refrigerated environment having a target temperature above 0° C., a freezer compartment for storing food items in a sub-freezing environment having a target temperature below 0° C., a system evaporator for providing a cooling effect to at least one of the fresh food compartment and the freezer compartment and an ice tray assembly disposed within the fresh food compartment for freezing water into ice pieces. The ice tray assembly includes an ice mold with an upper surface having a plurality of cavities formed therein for the ice pieces. A heater is disposed on the ice mold. An ice maker refrigerant tube abuts at least one lateral side surface of the ice mold and cools the ice mold to a temperature below 0° C. via thermal conduction. A bail arm is attached to a gear box of the ice tray assembly. The bail arm is pivotable between an upper position and a lower position wherein a leg of the bail arm is positioned underneath the ice mold when the bail arm is in the upper position.

In the foregoing refrigerator appliance, the bail arm may be L-shaped with a first leg attached to the gear box and a second leg extending from the first leg. The second leg may include a plurality of spaced-apart reinforcing ribs and be positioned underneath the ice mold when the bail arm is in the upper position.

In the foregoing refrigerator appliance, the first leg may be offset from the second leg relative to a pivot axis of the bail arm.

The refrigerator appliance may further include a cover having a water fill cup integrated into the cover and an outlet aligned with an inlet of the ice mold.

In the foregoing refrigerator appliance, the cover and the ice mold may be configured to capture a support bearing for an ice ejector therebetween and the support bearing may be part of an ice stripper of the ice tray assembly.

The refrigerator appliance may further include a sensor for detecting an angular position of the ice ejector.

In the foregoing refrigerator appliance, the sensor may be configured to detect an angular position of a feature of the ice ejector.

In the foregoing refrigerator appliance, the feature may be a contoured shape formed on a distal end of the ice ejector.

DESCRIPTION OF EXAMPLE EMBODIMENTS

Figure 1:
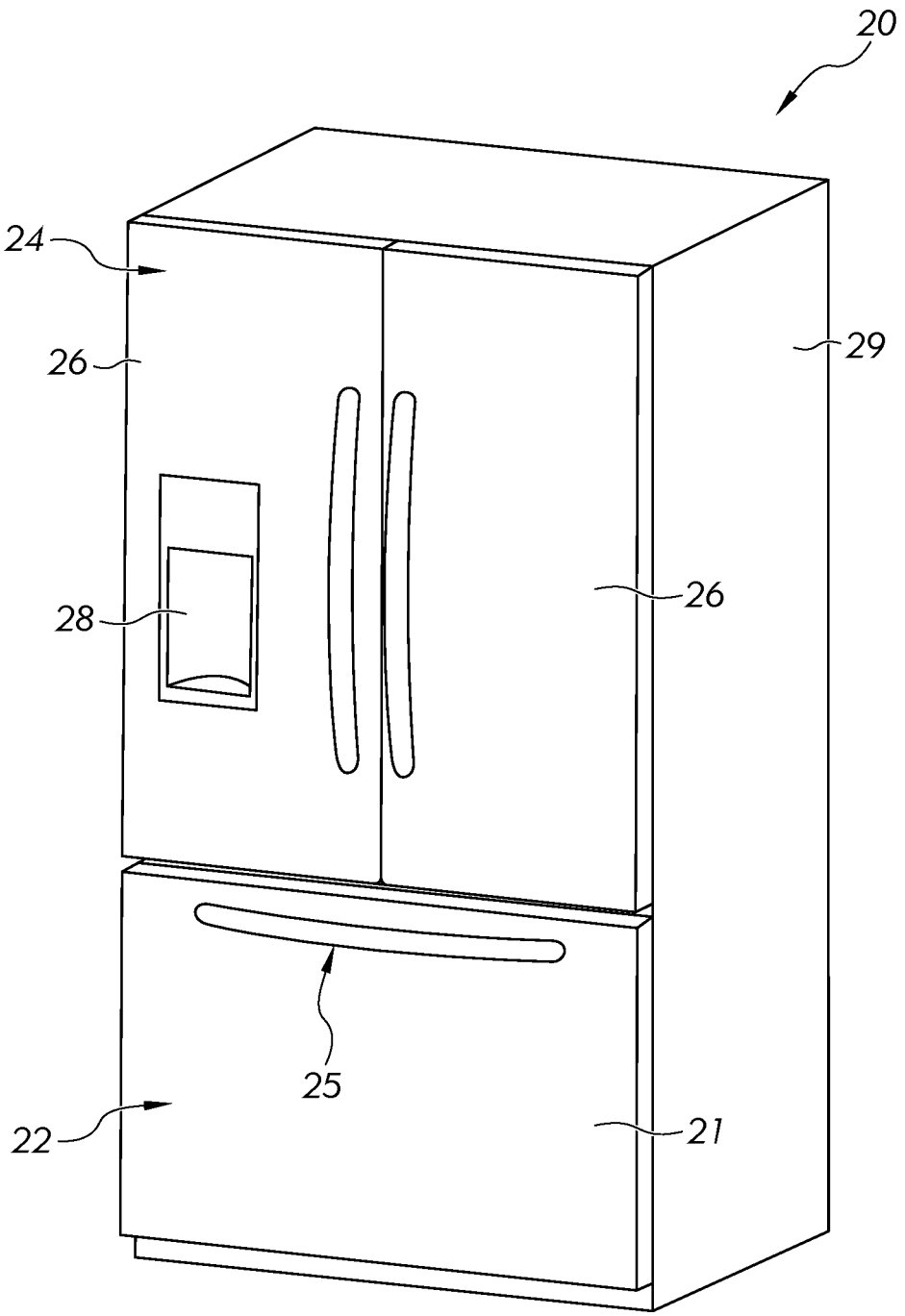
FIG. 1 is a front perspective view of a household French Door Bottom Mount showing doors of the refrigerator in a closed position.
Figure 2:
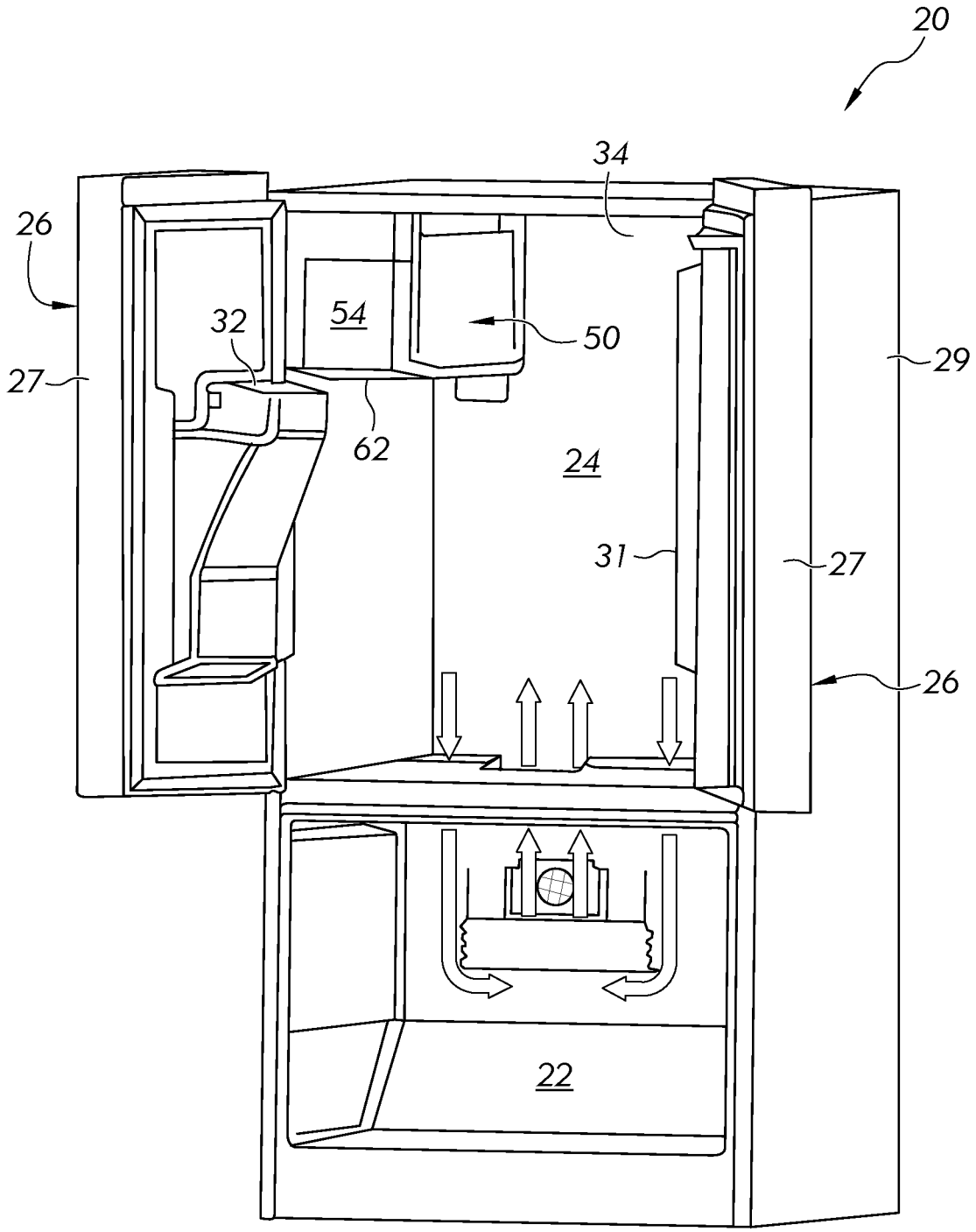
FIG. 2 is a front perspective view of the refrigerator of FIG. 1 showing the doors in an open position and an ice maker in a fresh food compartment.

Referring now to the drawings, FIG. 1 shows a refrigeration appliance in the form of a domestic refrigerator, indicated generally at 20. Although the detailed description that follows concerns a domestic refrigerator 20, the invention can be embodied by refrigeration appliances other than with a domestic refrigerator 20. Further, an embodiment is described in detail below, and shown in the figures as a bottom-mount configuration of a refrigerator 20, including a fresh food compartment 24 disposed vertically above a freezer compartment 22. However, the refrigerator 20 can have any desired configuration including at least a fresh food compartment 24 and an ice maker 50 (FIG. 2), such as a top mount refrigerator (freezer disposed above the fresh food compartment), a side-by-side refrigerator (fresh food compartment is laterally next to the freezer compartment), a standalone refrigerator or freezer, etc.

One or more doors 26 shown in FIG. 1 are pivotally coupled to a cabinet 29 of the refrigerator 20 to restrict and grant access to the fresh food compartment 24. The door 26 can include a single door that spans the entire lateral distance across the entrance to the fresh food compartment 24, or can include a pair of French-type doors 26 as shown in FIG. 1 that collectively span the entire lateral distance of the entrance to the fresh food compartment 24 to enclose the fresh food compartment 24. For the latter configuration, a center flip mullion 31 (FIG. 2) is pivotally coupled to at least one of the doors 26 to establish a surface against which a seal provided to the other one of the doors 26 can seal the entrance to the fresh food compartment 24 at a location between opposing side surfaces 27 (FIG. 2) of the doors 26. The mullion 31 can be pivotally coupled to the door 26 to pivot between a first orientation that is substantially parallel to a planar surface of the door 26 when the door 26 is closed, and a different orientation when the door 26 is opened. The externally-exposed surface of the center mullion 31 is substantially parallel to the door 26 when the center mullion 31 is in the first orientation, and forms an angle other than parallel relative to the door 26 when the center mullion 31 is in the second orientation. The seal and the externally-exposed surface of the mullion 31 cooperate approximately midway between the lateral sides of the fresh food compartment 24.

A dispenser 28 (FIG. 1) for dispensing at least ice pieces, and optionally water, can be provided on an exterior of one of the doors 26 that restricts access to the fresh food compartment 24. The dispenser 28 includes a lever, switch, proximity sensor or other device that a user can interact with to cause frozen ice pieces to be dispensed from an ice bin 54 (FIG. 2) of the ice maker 50 disposed within the fresh food compartment 24. Ice pieces from the ice bin 54 can exit the ice bin 54 through an aperture 62 and be delivered to the dispenser 28 via an ice chute 32 (FIG. 2), which extends at least partially through the door 26 between the dispenser 28 and the ice bin 54.

Referring to FIG. 1, the freezer compartment 22 is arranged vertically beneath the fresh food compartment 24. A drawer assembly (not shown) including one or more freezer baskets (not shown) can be withdrawn from the freezer compartment 22 to grant a user access to food items stored in the freezer compartment 22. The drawer assembly can be coupled to a freezer door 21 that includes a handle 25. When a user grasps the handle 25 and pulls the freezer door 21 open, at least one or more of the freezer baskets is caused to be at least partially withdrawn from the freezer compartment 22.

The freezer compartment 22 is used to freeze and/or maintain articles of food stored in the freezer compartment 22 in a frozen condition. For this purpose, the freezer compartment 22 is in thermal communication with a freezer evaporator 82 (FIG. 11) that removes thermal energy from the freezer compartment 22 to maintain the temperature therein at a temperature of 0° C. or less during operation of the refrigerator 20, preferably between 0° C. and −50° C., more preferably between 0° C. and −30° C. and even more preferably between 0° C. and −20° C.

The refrigerator 20 includes an interior liner 34 (FIG. 2) that defines the fresh food compartment 24. The fresh food compartment 24 is located in the upper portion of the refrigerator 20 in this example and serves to minimize spoiling of articles of food stored therein. The fresh food compartment 24 accomplishes this by maintaining the temperature in the fresh food compartment 24 at a cool temperature that is typically above 0° C., so as not to freeze the articles of food in the fresh food compartment 24. It is contemplated that the cool temperature preferably is between 0° C. and 10° C., more preferably between 0° C. and 5° C. and even more preferably between 0.25° C. and 4.5° C. According to some embodiments, cool air from which thermal energy has been removed by the freezer evaporator 82 can also be blown into the fresh food compartment 24 to maintain the temperature therein greater than 0° C. preferably between 0° C. and 10° C., more preferably between 0° C. and 5° C. and even more preferably between 0.25° C. and 4.5° C. For alternate embodiments, a separate fresh food evaporator (not shown) can optionally be dedicated to separately maintaining the temperature within the fresh food compartment 24 independent of the freezer compartment 22. According to an embodiment, the temperature in the fresh food compartment 24 can be maintained at a cool temperature within a close tolerance of a range between 0° C. and 4.5° C., including any subranges and any individual temperatures falling with that range. For example, other embodiments can optionally maintain the cool temperature within the fresh food compartment 24 within a reasonably close tolerance of a temperature between 0.25° C. and 4° C.

Figure 3:
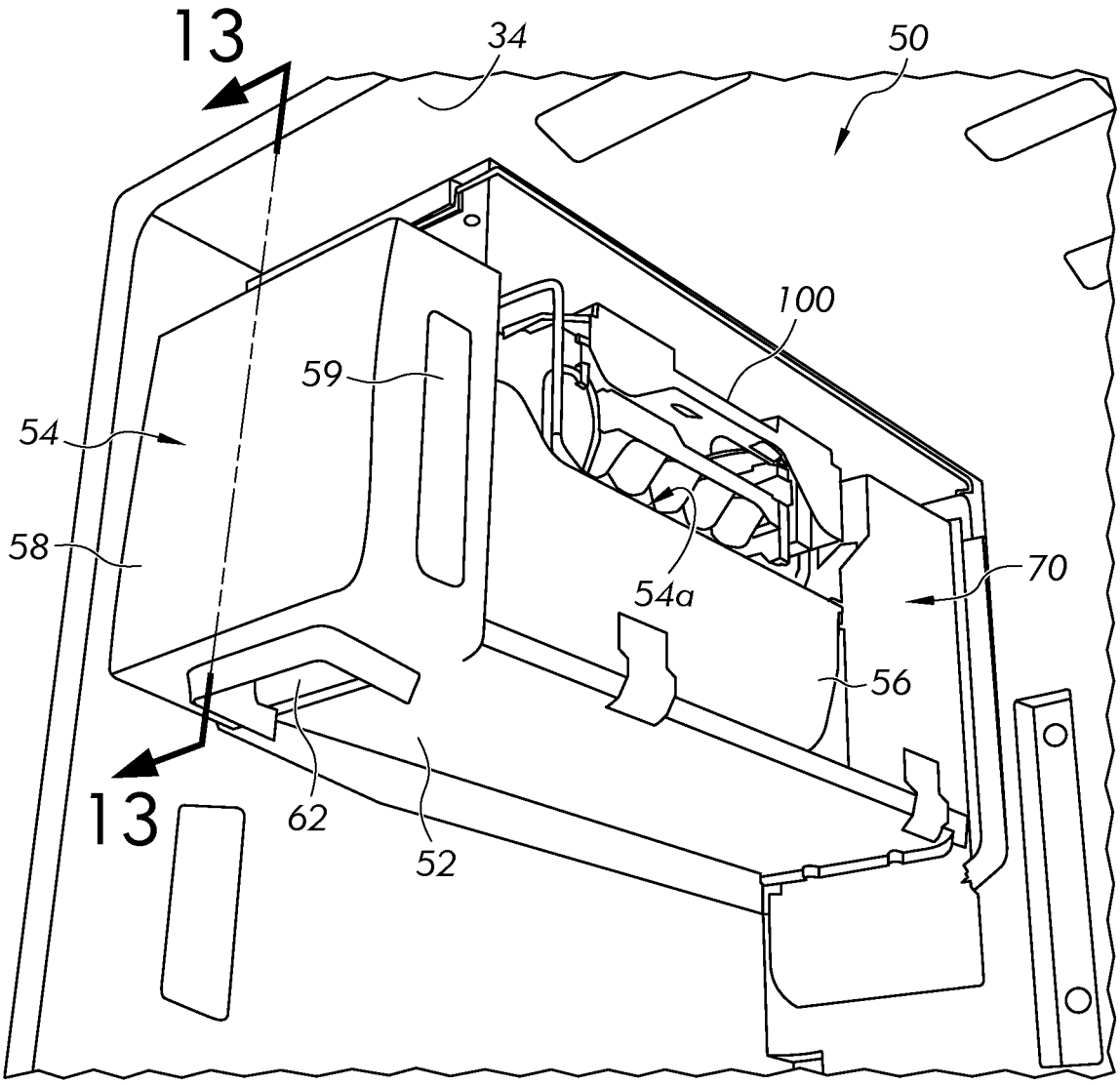
FIG. 3 is a side perspective view of an ice maker with a side wall of a frame of the ice maker removed for clarity.

An illustrative embodiment of the ice maker 50 is shown in FIG. 3. In general, the ice maker 50 includes a frame or enclosure 52, an ice bin 54, an air handler assembly 70 and an ice tray assembly 100. The ice bin 54 stores ice pieces made by the ice tray assembly 100 and the air handler assembly 70 circulates cooled air to the ice tray assembly 100 and the ice bin 54. The ice maker 50 is secured within the fresh food compartment 24 using any suitable fastener. The frame 52 is generally rectangular-in-shape for receiving the ice bin 54. The frame 52 includes insulated walls for thermally isolating the ice maker 50 from the fresh food compartment 24. A plurality of fasteners (not shown) may be used for securing the frame 52 of the ice maker 50 within the fresh food compartment 24 of the refrigerator 20. The ice tray assembly 100, in turn, is secured to the frame 52.

For clarity the ice maker 50 is shown with a side wall of the frame 52 removed; normally, the ice maker 50 would be enclosed by insulated walls. The ice bin 54 includes a housing 56 having an open, front end and an open top. A front cover 58 is secured to the front end of the housing 56 to enclose the front end of the housing 56. When secured together to form the ice bin 54, the housing 56 and the front cover 58 define an internal cavity 54*a* of the ice bin 54 used to store the ice pieces made by the ice tray assembly 100. The front cover 58 may be secured to the housing 56 by mechanical fasteners that can be removed using a suitable tool, examples of which include screws, nuts and bolts, or any suitable friction fitting possibly including a system of tabs allowing removal of the front cover 58 from the housing 56 by hand and without tools. Alternatively, the front cover 58 is non-removably secured in place on the housing 56 using methods such as, but not limited to, adhesives, welding, non-removable fasteners, etc. In various other examples, a recess 59 is formed in a side of the front cover 58 to define a handle that may be used by a user for ease in removing the ice bin 54 from the ice maker 50. An aperture 62 is formed in a bottom of the front cover 58. A rotatable auger (not shown) can extend along a length of the ice bin 54. As the auger rotates, ice pieces in the ice bin 54 are urged ice towards the aperture 62 wherein an ice crusher (not shown) is disposed. The ice crusher is provided for crushing the ice pieces conveyed thereto, when a user requests crushed ice. The augur can optionally be automatically activated and rotated by an auger motor assembly (not shown) of the air handler assembly 70. The aperture 62 is aligned with the ice chute 32 (FIG. 2) when the door 26 is closed. This alignment allows for the auger to push the frozen ice pieces stored in the ice bin 54 into the ice chute 32 to be dispensed by the dispenser 28.

Figure 4A:
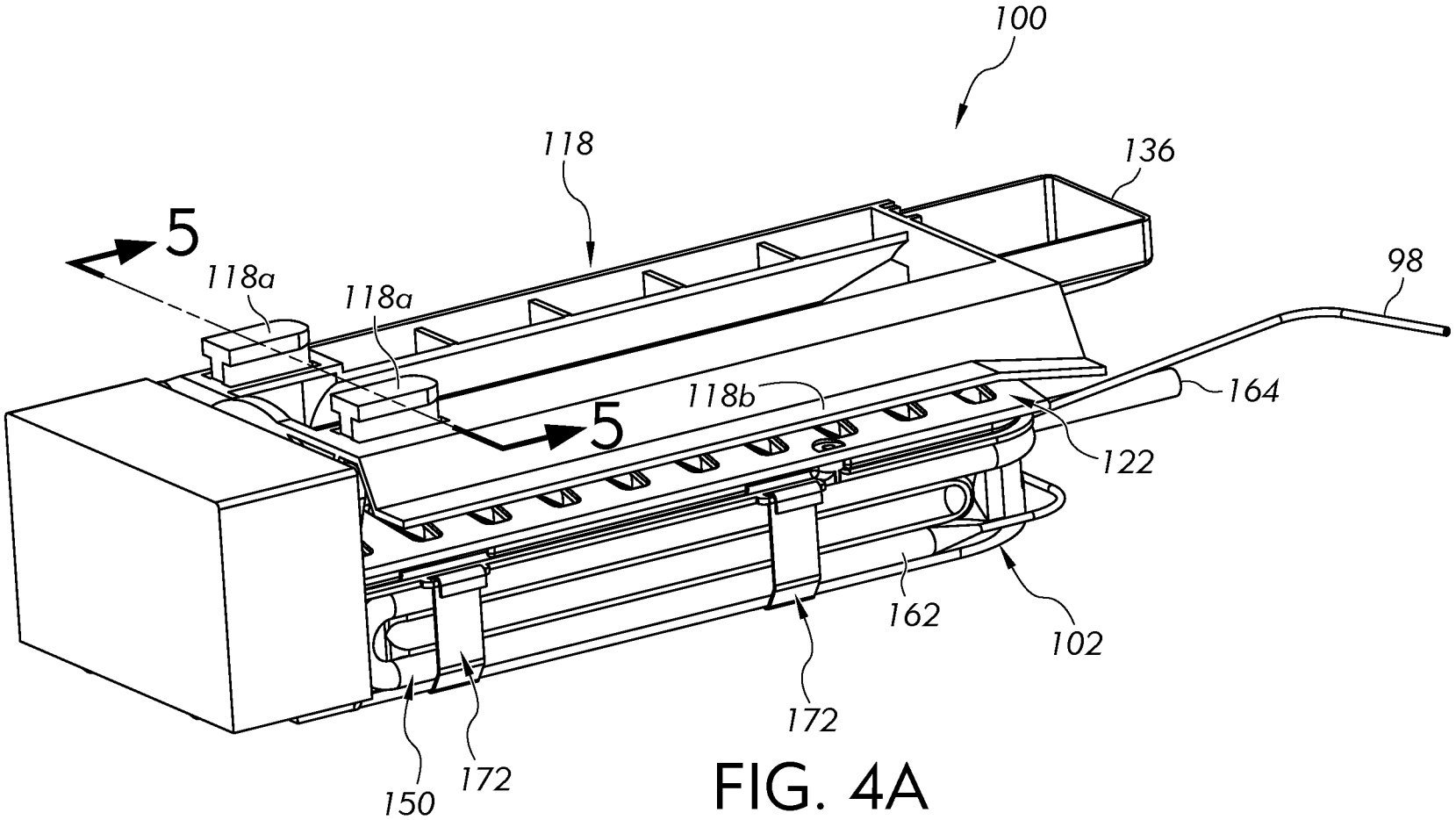
FIG. 4A is a side perspective view of a first embodiment of an ice tray assembly for the ice maker of FIG. 3.
Figure 4B:
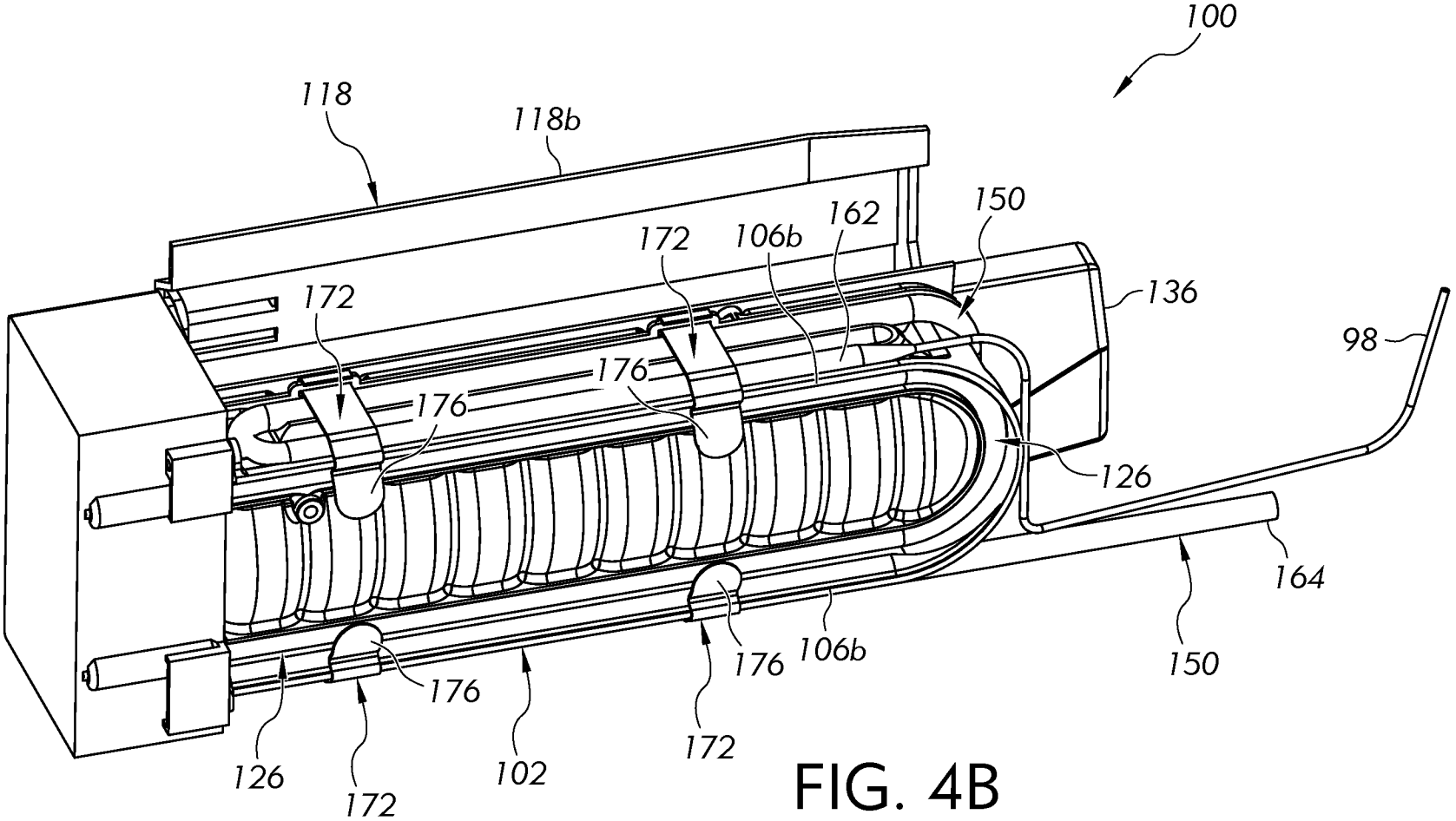
FIG. 4B is a bottom perspective view of the ice tray assembly of FIG. 4A.

Referring to FIGS. 4A and 4B, the ice tray assembly 100 includes an ice mold 102, a cover 118, a harvest heater 126 (FIGS. 4B and 5) for partially melting the ice pieces, a plurality of sweeper-arms 132 (FIG. 5) and an ice maker evaporator 150. The ice mold 102 is preferably made from a thermally conductive metal, like aluminum or steel. It is also preferred that the ice mold 102 is a single monolithic body.

Figure 5:
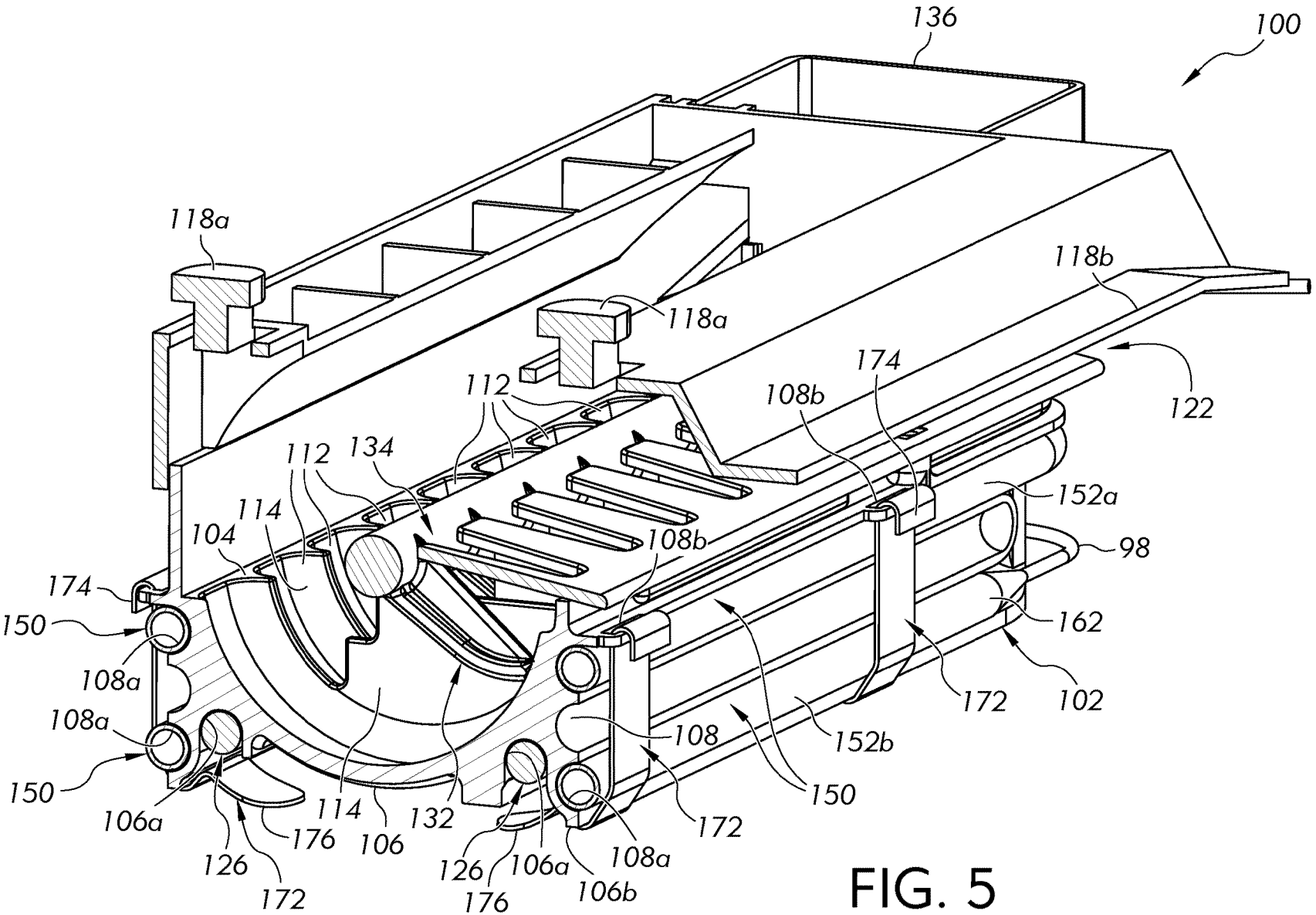
FIG. 5 is a section view of the ice tray assembly of FIG. 4A taken along line 5-5.

Referring to FIG. 5, the ice mold 102 includes a top surface 104, a bottom surface 106 and lateral side surfaces 108. A plurality of cavities 112 is formed in the top surface 104 of the ice mold 102. The plurality of cavities 112 is configured for receiving water to be frozen into ice pieces. The plurality of cavities 112 may be defined by weirs 114, and some or all of the weirs 114 have an aperture therethrough to enable water to flow among the cavities 112. The cavities 112 can have multiple variants. Different cube shapes and sizes are possible (e.g., crescent, cubical, hemispherical, cylindrical, star, moon, company logo, a combination of shapes and sizes simultaneously, etc.) as long as the ice pieces can be removed by the plurality of sweeper-arms 132. In the embodiment shown, the plurality of cavities 112 are aligned in a lateral direction of the ice mold 102.

The bottom surface 106 of the ice mold 102 is contoured to receive the harvest heater 126, as described in detail below. The bottom surface 106 includes a groove 106*a* that extends about a periphery of the bottom surface 106 for receiving the harvest heater 126 therein.

The lateral side surfaces 108 are contoured or sculpted to receive the ice maker evaporator 150. The lateral side surfaces 108 may include elongated recess 108*a* that closely match the outer profile of the ice maker evaporator 150, as described in detail below.

Referring to FIGS. 4A and 5, the cover 118 is attached to the top surface 104 of the ice mold 102 for securing the ice tray assembly 100 to the liner 34 of the fresh food compartment 24. The ice mold 102 may also be attached to an interior of the frame 52 of the ice maker 50 if installed as a unit. The cover 118 includes tabs 118*a* for securing the ice tray assembly 100 to mating openings (not shown) in the liner 34 or in a top wall of the frame 52. One longitudinal edge 118*b* of the cover 118 is dimensioned to be spaced from an upper edge of the ice mold 102 to define an opening 122. The opening 122 is dimensioned to allow ice pieces to be ejected from the ice tray assembly 100, as described in detail below.

Referring to FIGS. 4B and 5, the harvest heater 126 is attached to the bottom surface 106 of the ice mold 102 to provide a heating effect to the ice mold 102 to thereby separate congealed ice pieces from the ice mold 102 during an ice harvesting operation. The heater 126 may be an electric resistive heater, and may be capture in the groove 106*a* formed in the bottom surface 106 of the ice mold 102. The heater 126 is configured to be in direct or substantially direct contact with the ice mold 102 for increased conductive heat transfer. In the embodiment shown, the harvest heater 126 is a U-shape element that extends around a periphery of the bottom surface 106 and has a cylindrical outer surface. It is contemplated that the groove 106*a* may have a cylindrical contour that matches the outer cylindrical outer surface of the harvest heater 126. In the embodiment shown, the legs of the U-shaped heater 126 extend along the lateral direction of the ice mold 102. It is contemplated the heater 126 may have other shapes, for example, but not limited to, circular, oval, spiral, etc. so long as the heater 126 is disposed in direct or substantially direct contact with the ice mold 102.

The plurality of sweeper-arms 132 are disposed in the cavities 112 formed in the top surface 104 of the ice mold 102. The plurality of sweeper-arms 132 are elongated elements that are attached to a rotatable shaft 134. As the shaft 134 rotates the sweeper-arms 132 move through the cavities 112 to force ice pieces in the cavities 112 out of the ice mold 102. In the embodiment shown in FIG. 5, the shaft 134 extends in the lateral direction of the ice mold 102 and is rotatable in a clockwise direction such that the sweeper-arms 132 force the ice pieces into an area above the ice mold 102. A lower surface of the cover 118 is curved to direct the ice pieces toward the opening 122 between the cover 118 and the ice mold 102. As the sweeper-arms 132 continue to rotate, the ice pieces are then ejected from the ice tray assembly 100 into the ice bin 54 (FIG. 3) positioned below the ice tray assembly 100.

Prior to actuating the plurality of sweeper-arms 132, the harvest heater 126 is energized to heat the ice mold 102 which, in turn, melts a lower surface of the ice pieces in the plurality of cavities 112. A thin layer of liquid is formed on the lower surface of the ice pieces to aid in detaching the ice pieces from the ice mold 102. The plurality of sweeper-arms 132 may then eject the ice pieces out of the ice mold 102.

In the embodiment shown, the ice mold 102 is a monolithic body that includes an integrally formed water fill cup 136. It is contemplated that the water fill cup 136 may be made of the same material as the ice mold 102. In particular, it is contemplated that the ice mold 102 may be made of a metal material, e.g., aluminum or steel. The fill cup 136 includes side and bottom walls that are planar and sloped toward the cavities 112 in the ice mold 102. As such, water injected into the fill cup 136 will flow, by gravity to the cavities 112 in the ice mold 102. It is contemplated that the thermal energy provided by the harvest heater 126 may also be sufficient to melt frost or ice that may accumulate on the fill cup 136 during normal operation.

Figure 6:
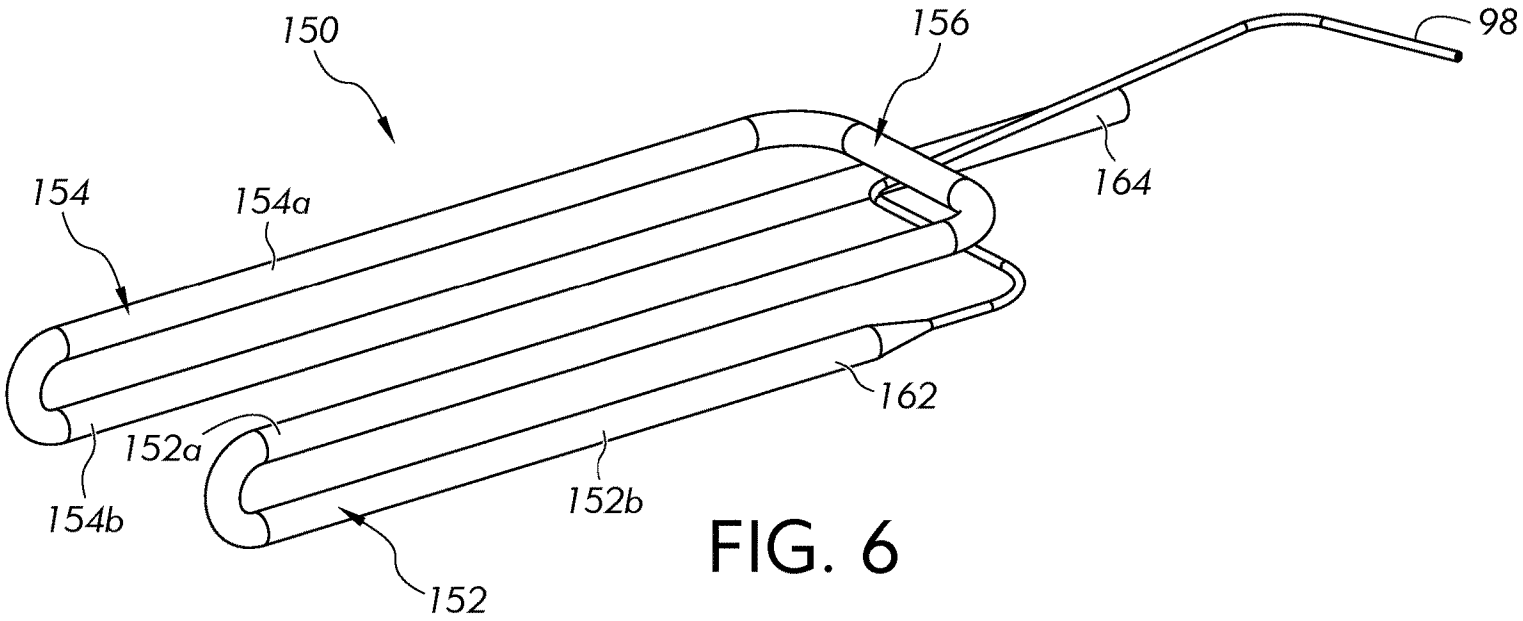
FIG. 6 is a side perspective view of an ice maker evaporator for the ice tray assembly of FIG. 4.

Referring to FIG. 6, the ice maker evaporator 150 includes a first leg 152, a second leg 154 and a connecting portion 156. In the embodiment shown, the first leg 152 is U-shaped and includes an upper portion 152*a* and a lower portion 152*b*. Similarly, the second leg 154 is U-shaped and includes an upper portion 154*a* and a lower portion 154*b*. The upper portions 152*a*, 154*a* and the lower portions 152*b*, 154*b* are illustrated in FIG. 6 as straight elongated elements that extend along the lateral direction of the ice mold 102. It is contemplated that these portions 152*a*, 154*a*, 152*b*, 154*b* can have other shapes, e.g., curved, wavy, tooth-shaped, stepped, etc. so long as these portions 152*a*, 154*a*, 152*b*, 154*b* are in intimate or surface-to-surface contact with the respective lateral side surfaces 108 of the ice mold 102. In the embodiment shown, the ice maker evaporator 150 has a U-shape. It is contemplated that the ice maker evaporator 150 may have other shapes so long as the ice maker evaporator 150 is in intimate contact with the ice mold 102.

The ice maker evaporator 150 includes an inlet end 162 for allowing a refrigerant to be injected into the ice maker evaporator 150 and an outlet end 164 for allowing the refrigerant to exit the ice maker evaporator 150. A first capillary tube 98 (described in detail below) is attached to the inlet end 162.

Referring to FIG. 5, in the embodiment shown, the ice maker evaporator 150 has a cylindrical outer surface and the respective recesses 108*a* formed in the lateral side surfaces 108 of the ice mold 102 have a matching contour. In the embodiment shown, the recesses 108*a* are contoured to preferably contact at least half or 180° of the cylindrical outer surface of the first and second legs 152, 154 of the ice maker evaporator 150. It is contemplated that the amount of contact may be more or less than half or 180°.

Retention clips 172 are provided for applying a retaining force to the ice maker evaporator 150 for securing the ice maker evaporator 150 into both lateral side surfaces 108 of the ice mold 102. In the embodiment shown, the clips 172 include an upper end 174 that is shaped for engaging a slotted opening 108*b* in the lateral side surface 108 of the ice mold 102. A lower end 176 of the clip 172 is shaped for allowing the clip 172 to attach to the bottom surface 106 of the ice mold 102. In the embodiment shown, the upper end 174 is J-shaped for securing the clip 172 to the slotted opening 108*b* and the lower end 176 is S-shaped to attach the clip 172 to an elongated rib 106*b* extending along opposite edges of the bottom surface 106 of the ice mold 102. The clip 172 is installed by inserting the upper end 174 into the slotted opening 108*b* and then rotating the clip 172 toward the ice mold 102 until the lower end 176 snaps or clips onto the elongated rib 106*b*, or an equivalent feature of the ice mold 102. The clips 172 are dimensioned and positioned to bias or maintain the ice maker evaporator 150 in intimate contact or abutment with the lateral side surfaces 108 of the ice mold 102. It is contemplated that the ice maker evaporator 150 may be configured to snap into the respective recesses 108*a* on the lateral side surfaces 108 of the ice mold 102.

Figure 7:
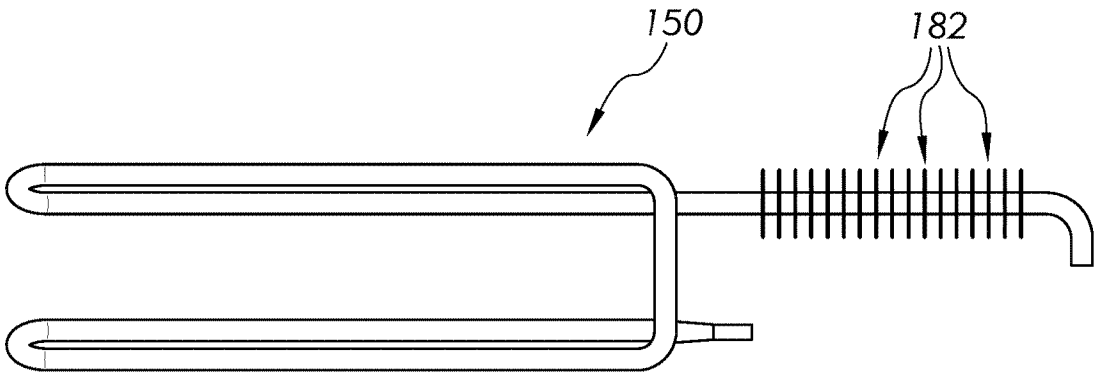
FIG. 7 is a top view of a second embodiment of an ice maker evaporator for the ice tray assembly of FIG. 4.
Figure 8:
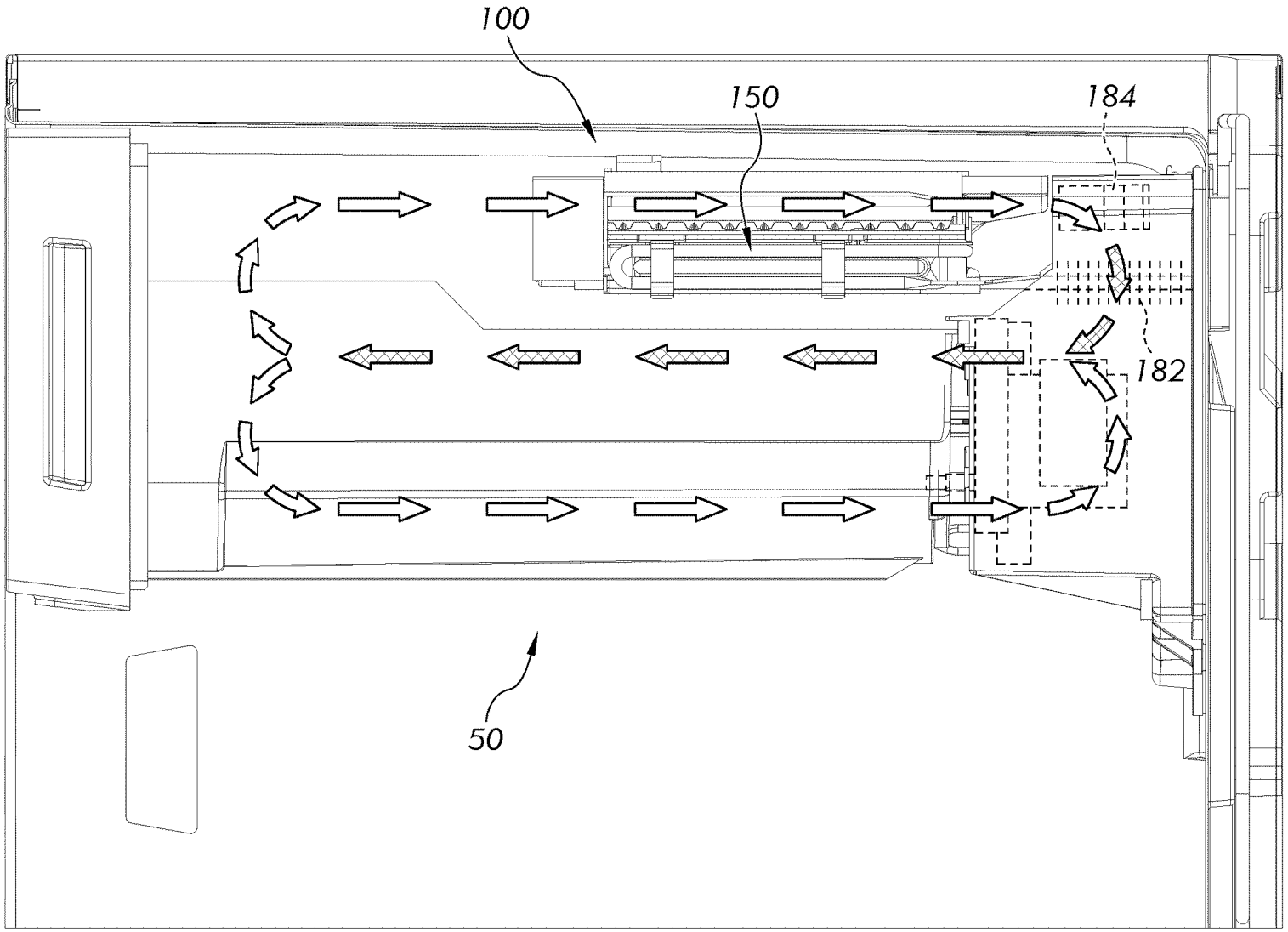
FIG. 8 is a side plane view of the ice maker of FIG. 3 with the ice maker evaporator of FIG. 7 wherein arrows illustrate an example air circulation path within the ice maker.

Referring to FIG. 7, according to another embodiment, the ice maker evaporator 150 may include a plurality of cooling fins 182. Referring to FIG. 8, when the ice maker evaporator 150 is disposed in the ice maker 50 the plurality of fins 182 may be positioned in the air handler assembly 70 proximate a circulation fan 184. When the fan 184 is energized, air is conveyed over the plurality of fins 182 and cooled air is circulated into the ice maker 50. Preferably, the cooled air is conveyed to the ice bin 54 to keep the ice pieces therein cold. Arrows in FIG. 8 illustrate the path of the air circulated within the ice maker 50 from the circulation fan conveying air over the ice maker evaporator 150.

Figure 9:
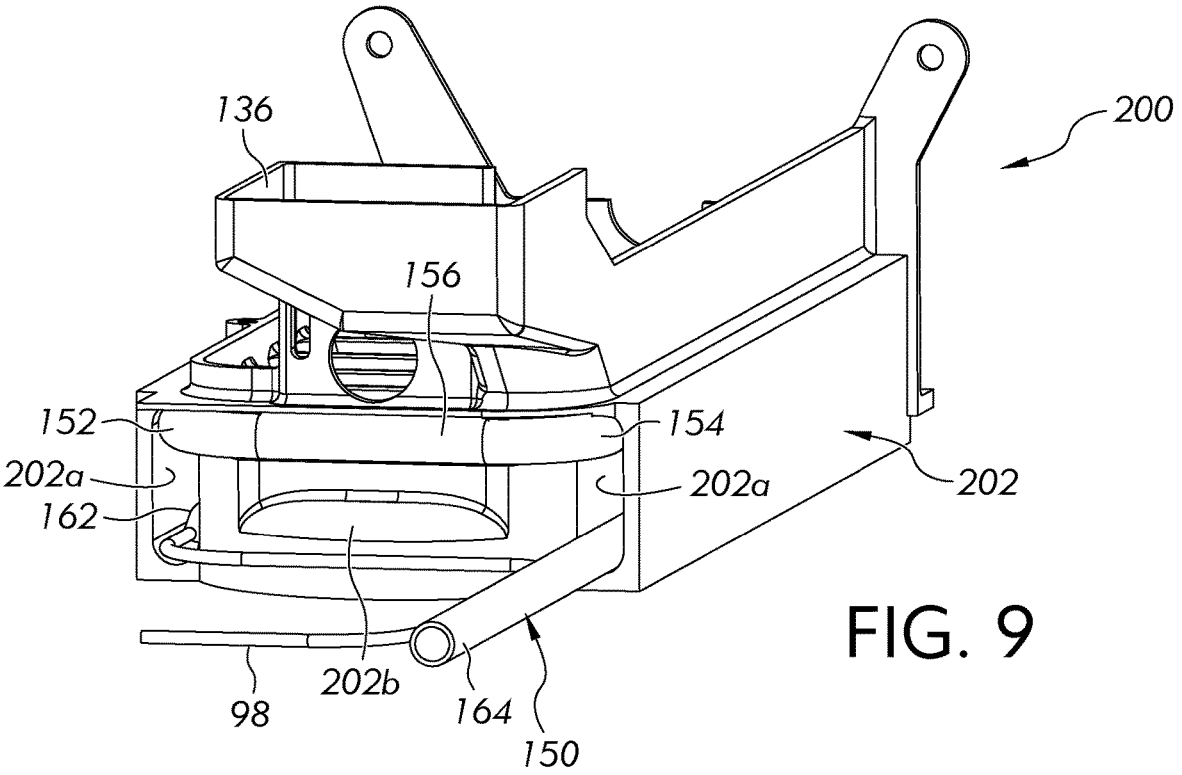
FIG. 9 is a rear perspective view of a second embodiment of an ice tray assembly.

Referring to FIG. 9, a second embodiment ice tray assembly 200 similar to ice tray assembly 100 is shown. The second ice tray assembly 200 includes an ice mold 202. The second ice tray assembly 200 includes other components that are similar or identical to the ice tray assembly 100, but these components are not shown or described in detail below. For example, similar to the ice mold 102, the ice mold 202 includes a plurality of cavities (not shown) that are configured for receiving water to be frozen into ice pieces.

The ice mold 202 includes elongated internal cavities 202*a* that extend along at least one, and preferably opposite sides of the ice mold 202 in the lateral direction of the ice mold 202. The elongated cavities 202*a* are dimensioned and positioned to receive the first leg 152 and preferably also the second leg 154 of the ice maker evaporator 150. The ice mold 202 includes a rear surface 202*b* that is contoured to receive the connecting portion 156 of the ice maker evaporator 150 when the ice maker evaporator 150 is fully inserted into the cavities 202*a*. A clip or fastener (not shown) may be used for securing the ice maker evaporator 150 to the ice mold 202. In the first embodiment ice tray assembly 100 described above, the first leg 152 and the second leg 154 of the ice maker evaporator 150 are positioned on external surfaces of the ice mold 102. In the second embodiment ice tray assembly 200, the first leg 152 and the second leg 154 of the ice maker evaporator 150 are positioned inside the ice mold 202.

Figure 10:
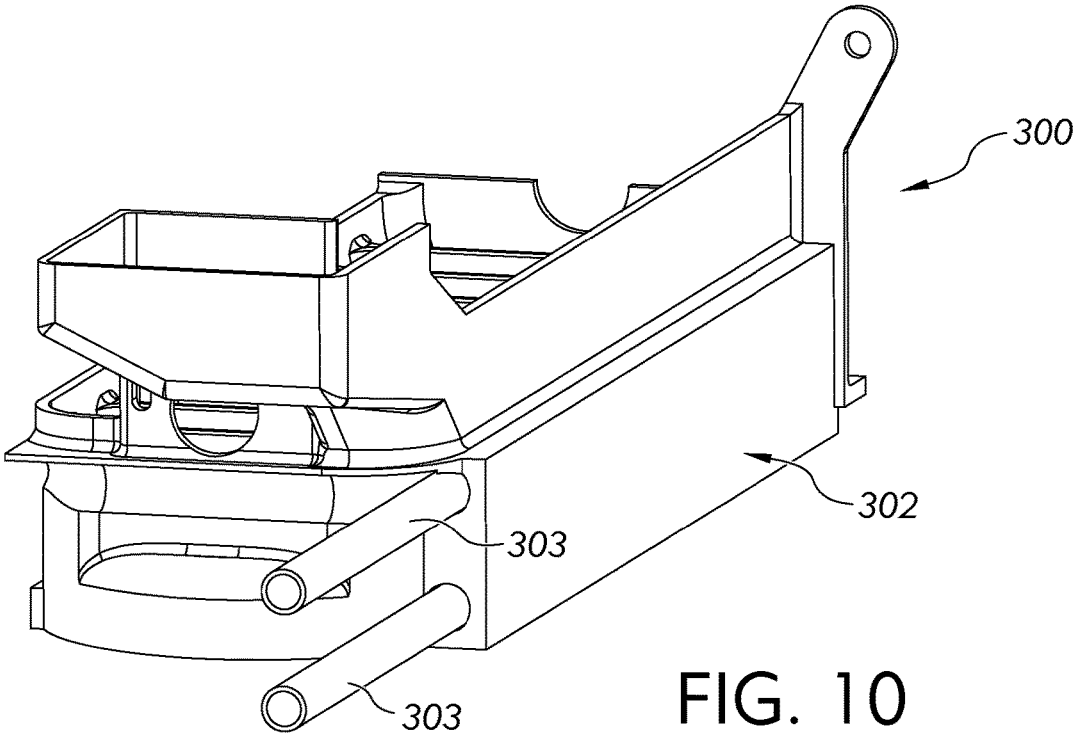
FIG. 10 is a rear perspective view of a third embodiment of an ice tray assembly.

Referring to FIG. 10, a third embodiment ice tray assembly 300 similar to the ice tray assembly 100 is shown. The third ice tray assembly 300 includes an ice mold 302. The third ice tray assembly 300 includes other components that are identical to the ice tray assembly 100, but these components are not shown or described in detail below. For example, similar to the ice mold 102, the ice mold 302 includes a plurality of cavities (not shown) that are configured for receiving water to be frozen into ice pieces. Similar to the second embodiment ice tray assembly 200, the third embodiment ice tray assembly 300 includes tubes 303 that are positioned inside the ice mold 302.

The ice mold 302 is a cast or molded block of metal, e.g., aluminum or steel that is cast around tubes 303 in a manner similar to an over-molding technique typically used in polymer manufacturing. The tubes 303 may be made from stainless steel or another high temperature material that withstands the heat required for casting the metal ice mold 302. Connectors (not shown) may be attached to the tubes 303 for fluidly connecting the tubes 303 to the cooling system of the refrigerator 20. In the embodiment shown, the tubes 303 are disposed along one side of the ice mold 302. The tubes 303 are connected by an internal U-channel (not shown). It is contemplated that the tubes 303 may also be disposed on the opposite lateral sides of the ice mold 302. The tubes 303, when connected to each other and the cooling system define a third ice maker evaporator 350. It is contemplated that the tubes 303 may be inserted into one or more holes (not shown) wherein an outer diameter of the tubes 303 is substantially equivalent to a diameter of the holes such that the tubes 303 are in intimate contact with the ice mold 302. It is also contemplated that the tubes 303 may be include threads for threading the tubes 303 into the ice mold 302. In the embodiment shown, the tubes 303 are parallel to a lower surface of the mold. It is contemplated that the tubes 303 may be sloped or angled relative to the lower surface of the mold.

It is also contemplated that instead of placing the tubes 303 in the ice mold 302 a plurality of passages (not shown) may be formed in the ice mold 302 itself and may extend through the ice mold 302 to define a flow path for the refrigerant. Appropriate connectors would be attached to the ice mold 302 itself for fluidly connecting the passages in the ice mold 302 to the appropriate portions of the cooling system of the refrigerator. As such, the ice mold 302 itself defines the ice maker evaporator 350.

The ice tray assemblies 100, 200, 300 of the instant application employ a direct cooling approach, in which the ice maker evaporators 150, 350 are in direct (or substantially direct) contact with the ice mold 102, 202, 302. The ice pieces are made without cold air ducted from a remote location (e.g., a freezer) to create or maintain the ice. It is understood that direct contact is intended to mean that the ice maker evaporator 150, 350 abuts the ice mold 102, 202, 302. Additionally, although no air is typically ducted from a remote location (e.g., a freezer) to create or maintain the ice, it is contemplated that cold air could be ducted from another location, such as about the system evaporator (not shown), if desired to increase a rate of ice making production or to maintain the stored ice pieces in the ice bin 54 at a frozen state. This could be useful, for example, in a configuration where the ice bin 54 is separated or provided at a distance apart from the ice maker evaporator 150, 350, or where accelerated ice formation is desired.

Still, although the term "evaporator" is used for simplicity, in yet another embodiment the ice maker evaporator 150, 350 could instead be a thermoelectric element (or other cooling element) that is operable to cool the ice mold 102, 202, 302 to a sufficient amount to congeal the water into ice pieces. Similar operative service lines (such as electrical lines) can be provided similar to the inlet/outlet lines described above.

Figure 11:
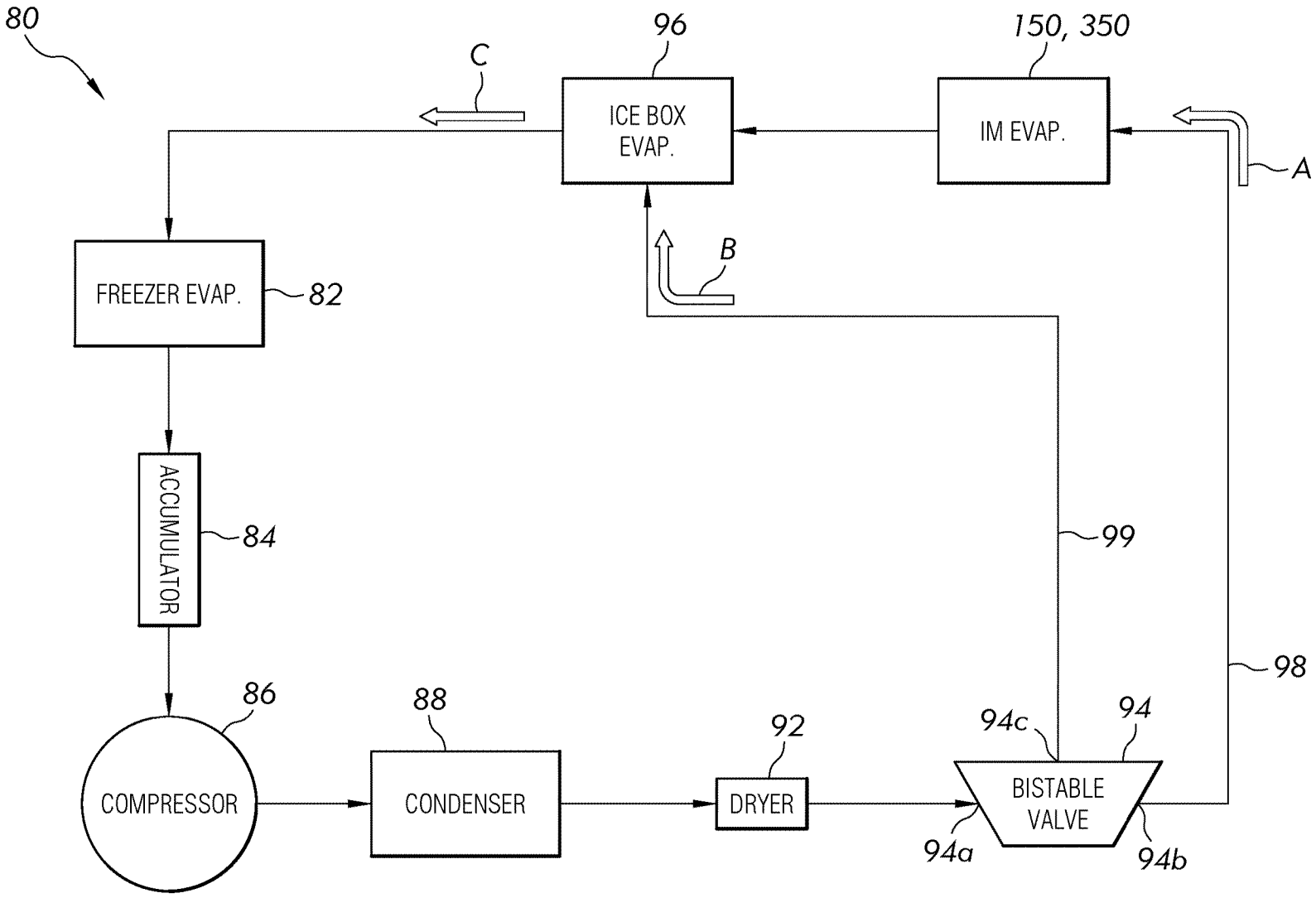
FIG. 11 is a schematic of a cooling system for the refrigerator of FIG. 1.

Referring to FIG. 11, a schematic of a cooling system 80 for the refrigerator 20 is shown. The cooling system 80 includes conventional components, such as a freezer evaporator 82, an accumulator 84 (optional), a compressor 86, a condenser 88 and a dryer 92. These components are conventional components that are well known to those skilled in the art and will not be described in detail herein.

The ice maker evaporator 150, 350 is connected between a valve 94 and an ice box evaporator 96. It is contemplated that both the valve 94 and the dryer 92 may be positioned in a machine room (not shown) of the refrigerator 20. The valve 94 includes a single inlet 94*a* and two outlets 94*b*, 94*c*. The inlet 94*a* is connected to the condenser 88 and optionally to the dryer 92. A first outlet 94*b* is connected to the ice maker evaporator 150, 350 (represented by arrow "A"). The first capillary tube 98 connects the first outlet 94*b* of the valve 94 to the ice maker evaporator 150, 350. A second outlet 94*c* is connected to the ice box evaporator 96 (represented by arrow "B"). A second capillary tube 99 connects the second outlet 94*c* of the valve 94 to the ice box evaporator 96. It is contemplated that the ice box evaporator 96 is an optional component. For example, the ice maker evaporator 96 may not be required if the ice maker evaporator 150 includes the cooling fins 182 that are sufficiently configured to maintain the ice pieces in the ice bin 54 at the desired temperature.

Figure 12:
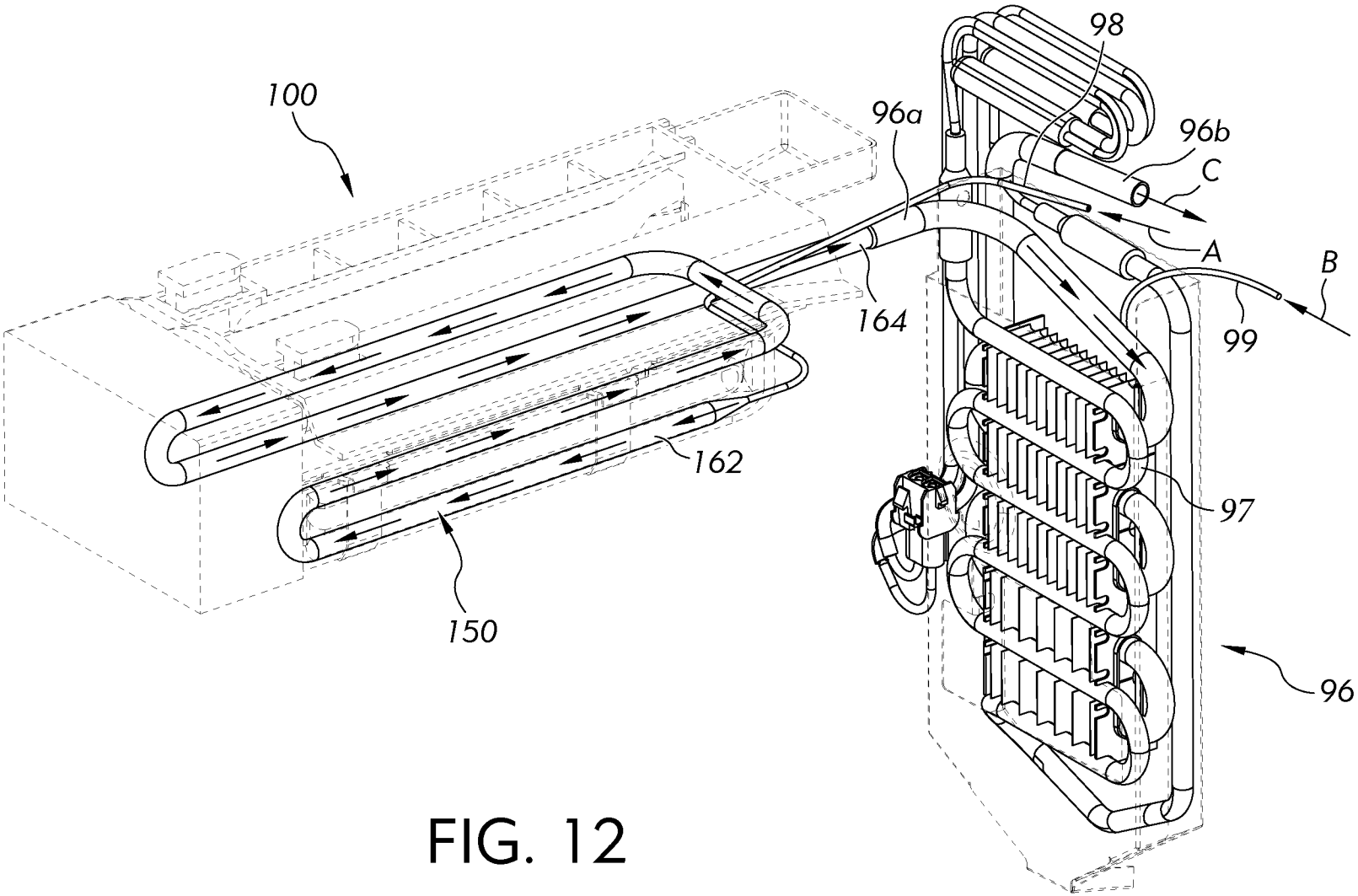
FIG. 12 is a side perspective view of the ice maker evaporator of FIG. 6 and an ice box evaporator illustrating an example flow path of a refrigerant through the ice maker evaporator and the ice box evaporator.

FIG. 12 shows one embodiment wherein the ice maker evaporator 150 is connected to the ice box evaporator 96. When the valve 94 is in a first position (i.e., in through the inlet 94*a* and out through the first outlet 94*b*) the refrigerant flows along the flow path "A" through the first capillary tube 98 and enters the inlet end 162 of the ice maker evaporator 150, flows through the ice maker evaporator 150, exits the outlet end 164, enters an inlet end 96*a* of the ice box evaporator 96, flows through the ice box evaporator 96 and exits an outlet end 96*b* of the ice box evaporator 96 (represented by arrow "C"). When the valve 94 is in a second position (i.e., in through the inlet 94*a* and out through the second outlet 94*c*), the refrigerant flows along the flow path "B" through the second capillary tube 99 and enters the inlet end 96*a* of the ice box evaporator 96, flows through the ice box evaporator 96 and exits the outlet end 96*b* of the ice box evaporator (represented by arrow "C"). As such, when the valve 94 is in the second position the refrigerant bypasses the ice maker evaporator 150.

During an ice harvesting process, a full bucket mode, a defrosting of the ice box evaporator 96 or when the ice maker 50 is "OFF," the valve 94 is in the second position such that the second outlet 94*c* is fluidly connected to the ice box evaporator 96 and the refrigerant bypasses the ice maker evaporator 150, 350. During other processes/modes of operation, the valve 94 is in the first position such that the first outlet 94*b* of the valve 94 is connected to the ice maker evaporator 150, 350 and the refrigerant flows through the ice maker evaporator 150, 350 and then to the ice box evaporator 96.

Figure 14:
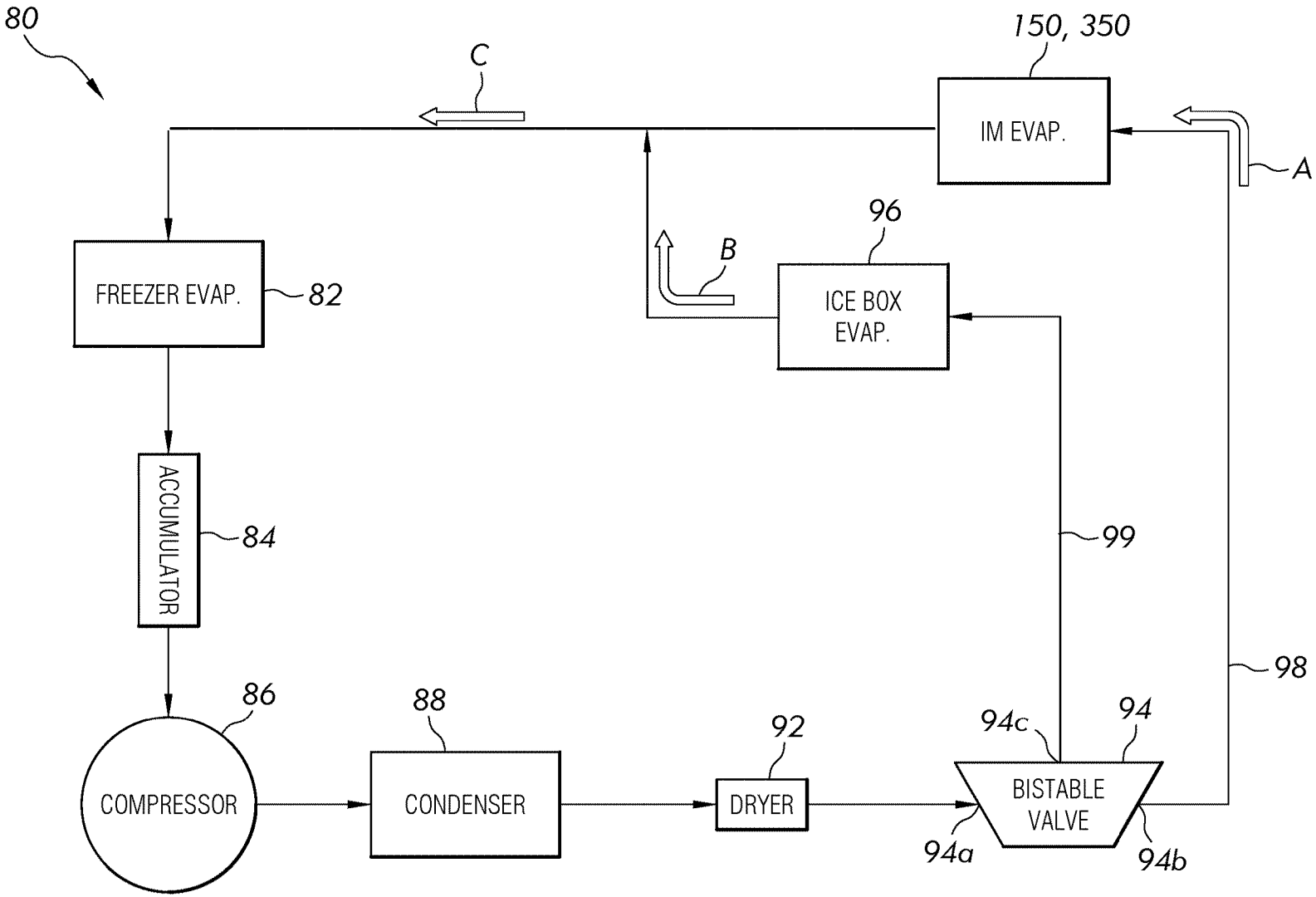
FIG. 14 is a schematic of a second embodiment cooling system for the refrigerator of FIG. 1'

FIG. 14 illustrates a second embodiment wherein the ice box evaporator 96 and the ice maker evaporator 150, 350 are disposed in parallel paths. The ice maker evaporator 150, 350 is connected to the first outlet 94*b* of the bistable valve 94 by the first capillary tube 98 and the ice box evaporator 96 is connected to the second outlet 94*c* of the bistable valve 94 by the second capillary tube 99. When the valve 94 is in a first position (i.e., in through the inlet 94*a* and out through the first outlet 94*b*) the refrigerant flows along the flow path "A" through the first capillary tube 98 and the ice maker evaporator 150. When the valve 94 is in a second position (i.e., in through the inlet 94*a* and out through the second outlet 94*c*), the refrigerant flows along the flow path "B" through the second capillary tube 99 and the ice box evaporator 96. As such, when the valve 94 is in the second position the refrigerant bypasses the ice maker evaporator 150 and when the valve 94 is in the first position the refrigerant bypasses the ice box evaporator 96. As shown in FIG. 14, the ice box evaporator 96 is disposed in a bypass line or path around the ice maker evaporator 150, 350. Alternatively, the ice maker evaporator 150, 350 is disposed in a bypass line or path around the ice box evaporator 96.

During an ice harvesting process, a full bucket mode, a defrosting of the ice box evaporator 96 or when the ice maker 50 is "OFF," the valve 94 is in the second position such that the second outlet 94*c* is fluidly connected to the ice box evaporator 96 and the refrigerant bypasses the ice maker evaporator 150, 350. During other processes/modes of operation, the valve 94 is in the first position such that the first outlet 94*b* of the valve 94 is connected to the ice maker evaporator 150, 350 and bypasses the ice box evaporator 96.

The switching of the valve 94 is designed to reduce the operational cost of the cooling system 80 for the ice maker 50. For simplicity, the housing of the air handler assembly 70 is not shown in FIG. 12. Arrows in FIG. 12 illustrate that path of the refrigerant through the ice maker evaporator 150 and the ice box evaporator 96.

It is contemplated that the valve 94 may be, such as but not limited to, a bistable valve, a stepper valve or an electronic expansion valve that is configured to control the flow of refrigerant entering the ice maker evaporator 150, 350. The bistable valve may be a binary valve, i.e., an "either/or" valve wherein 100% of the flow exits through either the first outlet 94*b* or the second outlet 94*c*. The electronic expansion valve allows the flow of refrigerant to the ice maker evaporator 150, 350 independently of the flow of the refrigerant to the ice box evaporator 96. Thus, the flow of refrigerant to the ice maker evaporator 150, 350 can be discontinued as appropriate during ice making even though the compressor 86 is operational and refrigerant is being delivered to the ice box evaporator 96. Additionally, the opening and closing of the electronic expansion valve can be controlled to regulate the temperature of at least one of the ice maker evaporator 150, 350 and the ice box evaporator 96. A duty cycle of the electronic expansion valve, in addition to or in lieu of the operation of the compressor 86, can be adjusted to change the amount of refrigerant flowing through the ice maker evaporator 150, 350 based on the demand for cooling. There is a greater demand for cooling by the ice maker evaporator 150, 350 while water is being frozen to form the ice pieces than there is when the ice pieces are not being produced. It is therefore possible to avoid changing the operation of the compressor 86 while the electronic expansion valve is operational to account for the needs of the ice maker evaporator 150, 350.

When ice is to be produced by the ice maker 50, a controller (not shown) can at least partially open the electronic expansion valve. After passing through the electronic expansion valve the refrigerant enters the ice maker evaporator 150, 350 where it expands and at least partially evaporates into a gas. The latent heat of vaporization required to accomplish the phase change is drawn from the ambient environment of the ice maker evaporator 150, 350, thereby lowering the temperature of an external surface of the ice maker evaporator 150, 350 to a temperature that is below 0° C. The temperature of the portion of the ice molds 102, 202, 302 exposed to the external surface of the ice maker evaporator 150, 350 decreases thereby causing water in the cavities 112 to freeze and form the ice pieces.

Figure 13:
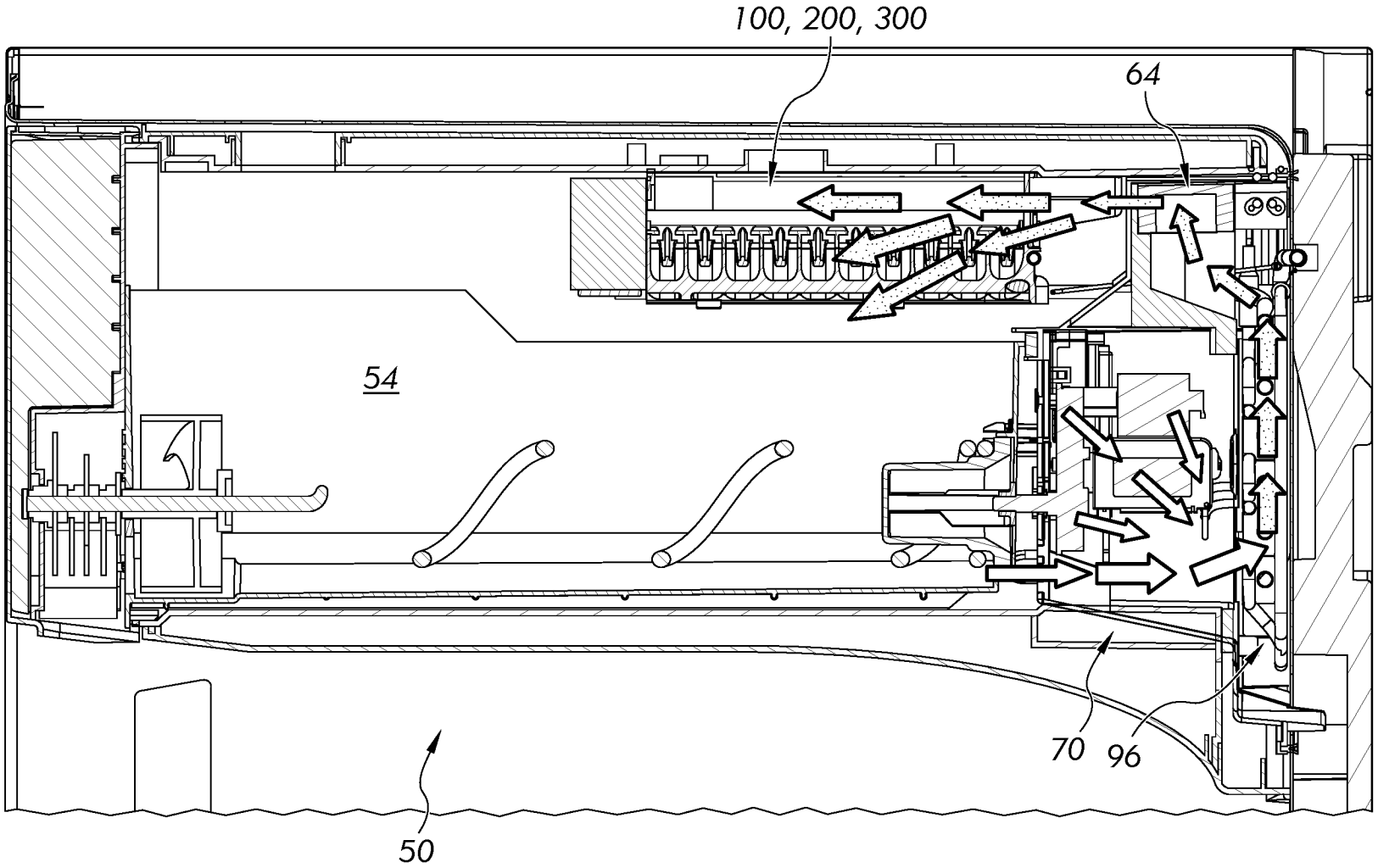
FIG. 13 is a side section view taken along line 13-13 of FIG. 3.

Referring to FIG. 13, the ice maker 50 includes a circulation fan 64. The ice box evaporator 96 is disposed proximate the circulation fan 64 such that air is drawn from the ice bin 54, over the ice box evaporator 96 and back to the ice bin 54. It is contemplated that the circulation fan 64 may be a centrifugal or squirrel-cage type fan wherein air is drawn into a center of the fan 64 and then exhausted radially away from the fan. It is also contemplated that the circulation fan 64 may be an axial fan wherein air is conveyed through the fan along a rotational axis of the fan. It is contemplated that the ice box evaporator 96 may include a heater 97 (FIG. 12) that may be energized during a defrost cycle of the ice box evaporator 96. The heater may be configured such that heat generated by the heater is sufficient to defrost both the ice box evaporator 96 and the fill cup 136 (FIG. 5) of the ice tray assembly 100.

The dedicated ice maker evaporator 150, 350 removes thermal energy from water in the ice mold 102, 202, 302 to create the ice pieces. As described previously herein, the ice maker evaporator 150, 350 may be configured to be a portion of the same refrigeration loop as the freezer evaporator 82 that provides cooling to the freezer compartment 22 of the refrigerator 20. In various examples, the ice maker evaporator 150, 350 can be provided in serial or parallel configurations with the freezer evaporator 82. In yet another example, the ice maker evaporator 150, 350 can be configured as a completely independent refrigeration system.

In addition or alternatively, the ice maker of the present application may further be adapted to mounting and use on a freezer door. In this configuration, although still disposed within the freezer compartment, at least the ice maker (and possibly an ice bin) is mounted to the interior surface of the freezer door. It is contemplated that the ice mold and ice bin can be separated elements, in which one remains within the freezer cabinet and the other is on the freezer door.

Cold air can be ducted to the freezer door from an evaporator in the fresh food or freezer compartment, including the system evaporator. The cold air can be ducted in various configurations, such as ducts that extend on or in the freezer door, or possibly ducts that are positioned on or in the sidewalls of the freezer liner or the ceiling of the freezer liner. In one example, a cold air duct can extend across the ceiling of the freezer compartment, and can have an end adjacent to the ice maker (when the freezer door is in the closed condition) that discharges cold air over and across the ice mold. If an ice bin is also located on the interior of the freezer door, the cold air can flow downwards across the ice bin to maintain the ice pieces at a frozen state. The cold air can then be returned to the freezer compartment via a duct extending back to the evaporator of the freezer compartment. A similar ducting configuration can also be used where the cold air is transferred via ducts on or in the freezer door. The ice mold can be rotated to an inverted state for ice harvesting (via gravity or a twist-tray) or may include a sweeper-finger type, and a heater can be similarly used. It is further contemplated that although cold air ducting from the freezer evaporator as described herein may not be used, a thermoelectric chiller or other alternative chilling device or heat exchanger using various gaseous and/or liquid fluids could be used in its place. In yet another alternative, a heat pipe or other thermal transfer body can be used that is chilled, directly or indirectly, by the ducted cold air to facilitate and/or accelerate ice formation in the ice mold. Of course, it is contemplated that the ice maker of the instant application could similarly be adapted for mounting and use on a freezer drawer.

Alternatively, it is further contemplated that the ice maker of the instant application could be used in a fresh food compartment, either within the interior of the cabinet or on a fresh food door. It is contemplated that the ice mold and ice bin can be separated elements, in which one remains within the fresh food cabinet and the other is on the fresh food door.

In addition or alternatively, cold air can be ducted from another evaporator in the fresh food or freezer compartment, such as the system evaporator. The cold air can be ducted in various configurations, such as ducts that extend on or in the fresh food door, or possibly ducts that are positioned on or in the sidewalls of the fresh food liner or the ceiling of the fresh food liner. In one example, a cold air duct can extend across the ceiling of the fresh food compartment, and can have an end adjacent to the ice maker (when the fresh food door is in the closed condition) that discharges cold air over and across the ice mold. If an ice bin is also located on the interior of the fresh food door, the cold air can flow downwards across the ice bin to maintain the ice pieces at a frozen state. The cold air can then be returned to the fresh food compartment via a ducting extending back to the compartment with the associated evaporator, such as a dedicated icemaker evaporator compartment or the freezer compartment. A similar ducting configuration can also be used where the cold air is transferred via ducts on or in the fresh food door. The ice mold can be rotated to an inverted state for ice harvesting (via gravity or a twist-tray) or may include a sweeper-finger type, and a heater can be similarly used. It is further contemplated that although cold air ducting from the freezer evaporator (or similarly a fresh food evaporator) as described herein may not be used, a thermoelectric chiller or other alternative chilling device or heat exchanger using various gaseous and/or liquid fluids could be used in its place. In yet another alternative, a heat pipe or other thermal transfer body can be used that is chilled, directly or indirectly, by the ducted cold air to facilitate and/or accelerate ice formation in the ice mold. Of course, it is contemplated that the ice maker of the instant application could similarly be adapted for mounting and use on a fresh food drawer.

Figure 15:
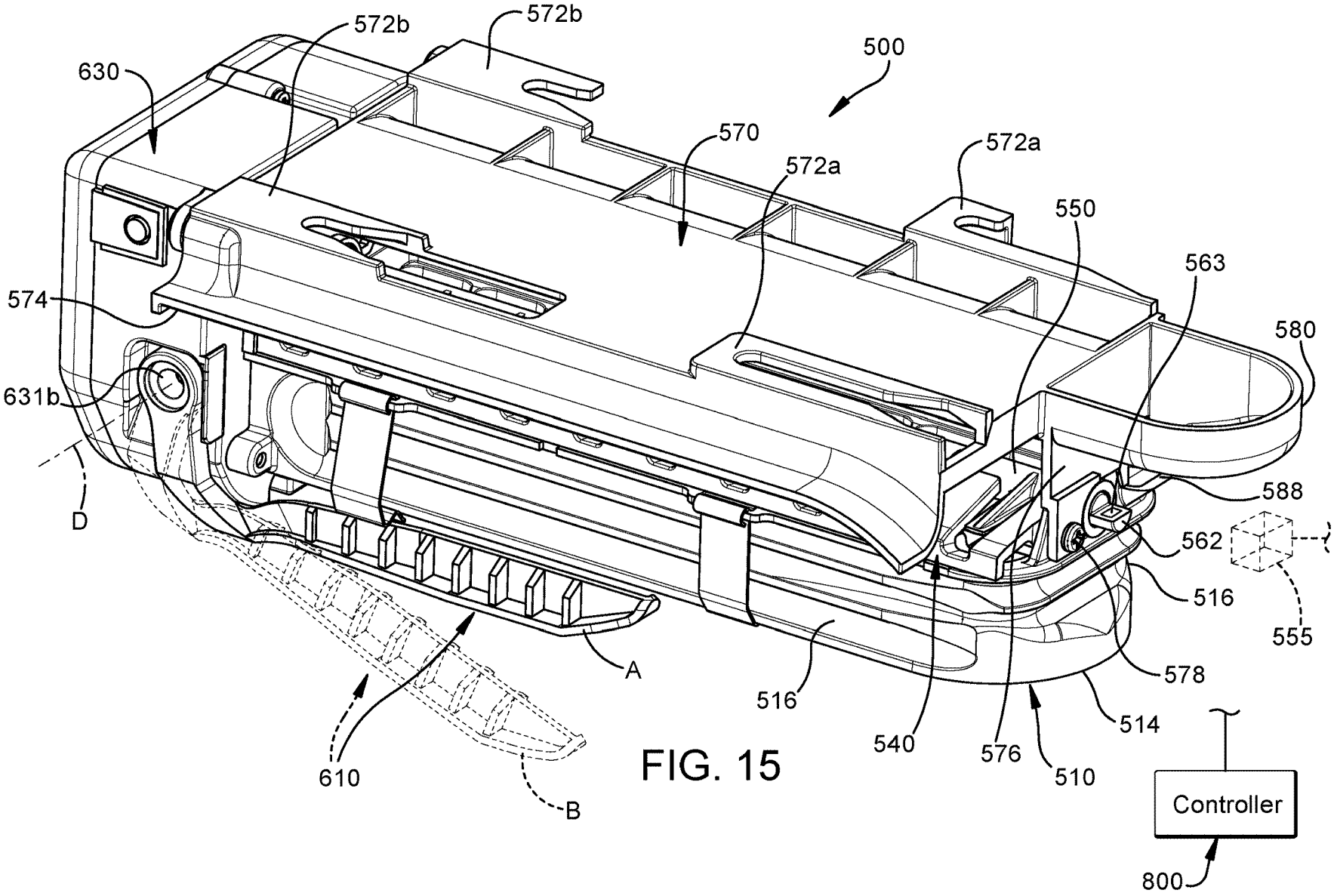
FIG. 15 is a side perspective view of a fourth embodiment of an ice tray assembly for the ice maker of FIG. 3 illustrating a bail arm in both a first, upper position and a second, lower position.

FIGS. 15-23 illustrate a fourth embodiment of an ice tray assembly 500. Referring to FIG. 15, the ice tray assembly 500, in general, includes an ice mold 510, an ice stripper 540, an ice ejector 550, a cover 570, a gear box 630 and a bail arm 610.

Figure 16:
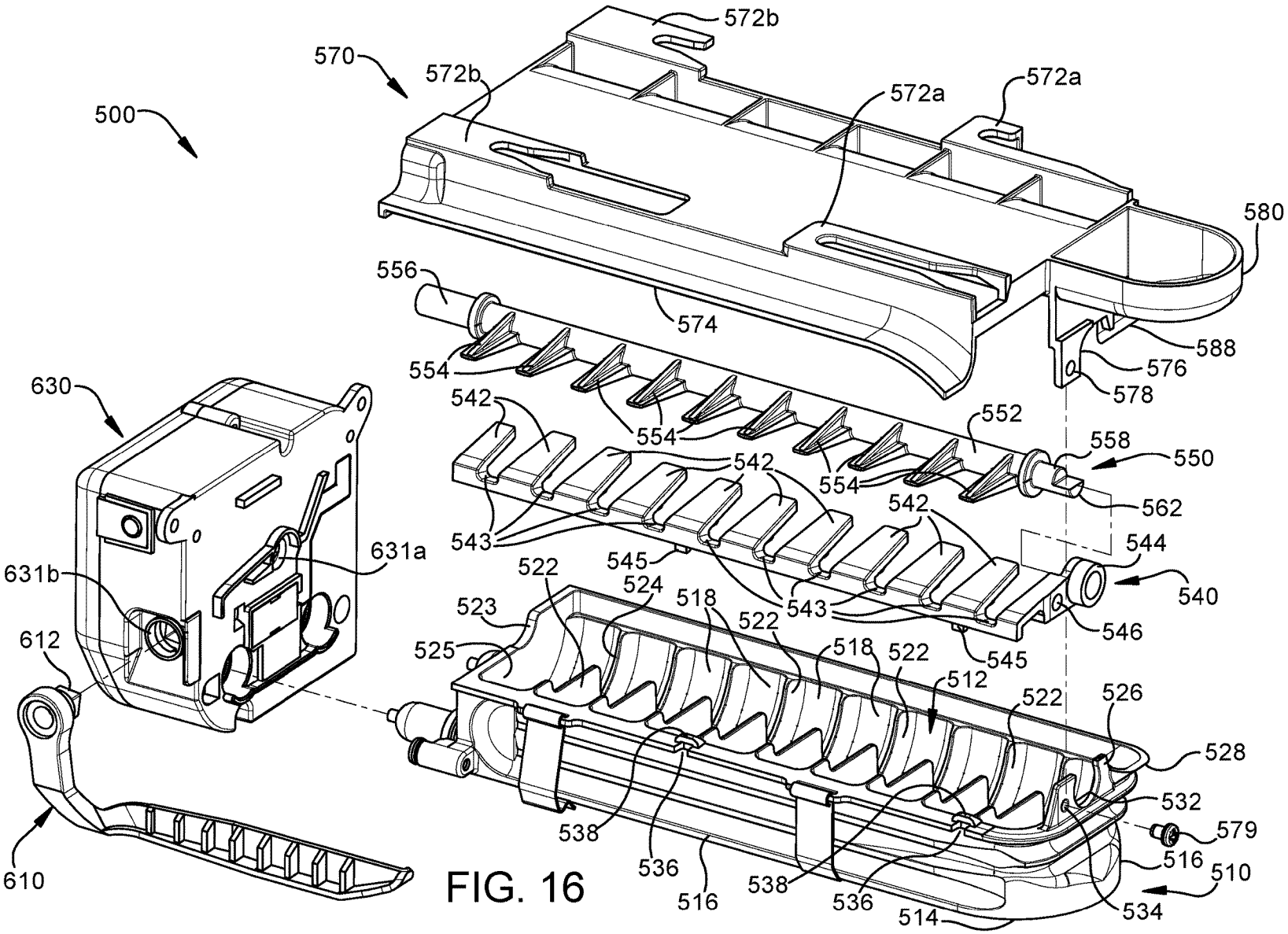
FIG. 16 is an exploded view of the ice tray assembly of FIG. 15.
Figure 20:
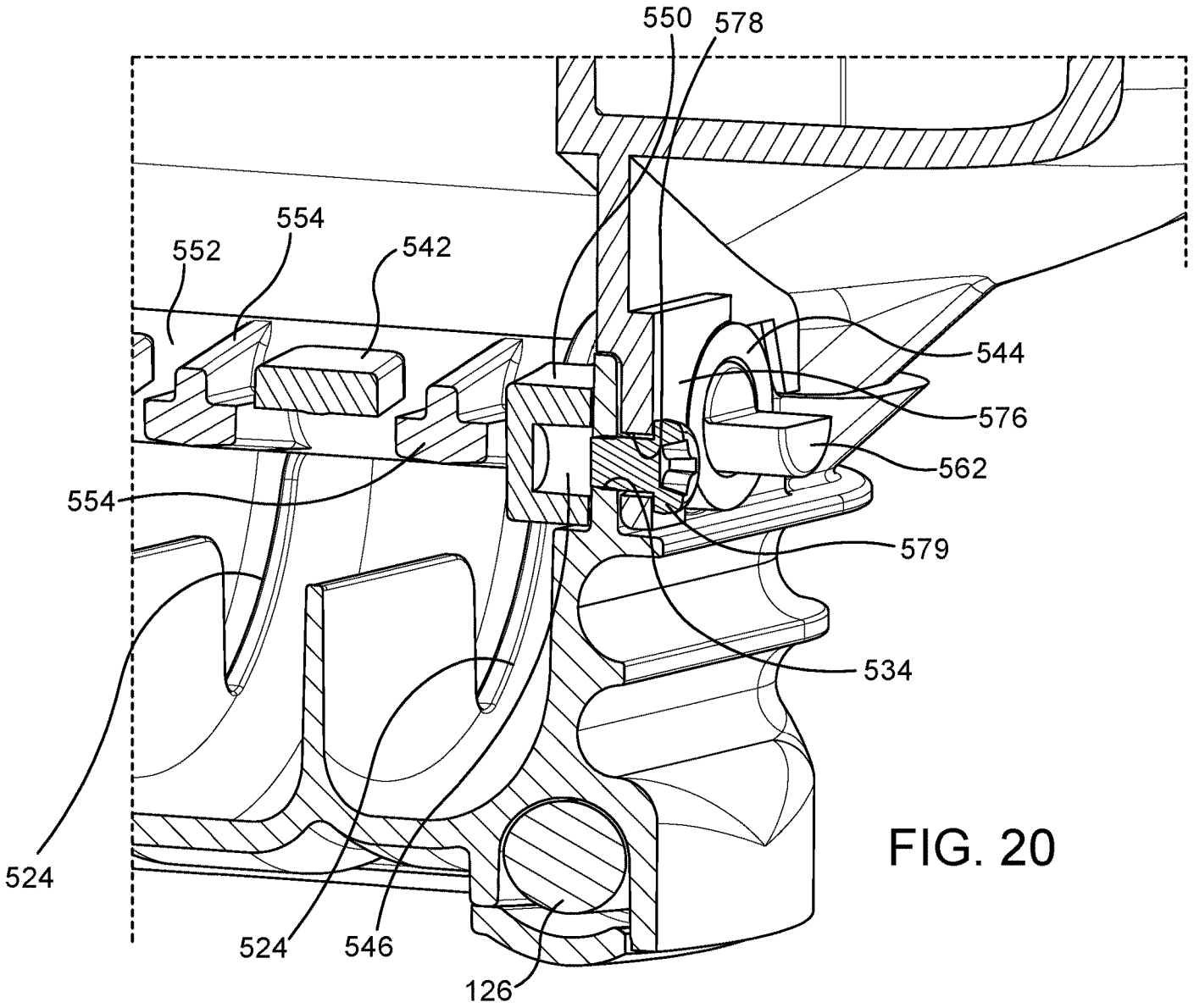
FIG. 20 is a section view taken along lines 20-20 of FIG. 18.

Referring to FIG. 16, the ice mold 510 is preferably made from a thermally conductive metal, like aluminum or steel. It is also preferred that the ice mold 510 is a single monolithic body. The ice mold 510 includes a top 512, a bottom 514 and lateral sides 516. A plurality of cavities 518 is formed in the top 512 of the ice mold 510. The plurality of cavities 518 is configured for receiving water to be frozen into ice pieces. The plurality of cavities 518 may be defined by weirs 522, and some or all of the weirs 522 have an aperture 524 therethrough to enable water to flow among the cavities 518. Referring to FIG. 20, the aperture 524 is contoured to extend to a location near a bottom of the cavities 518 for improving the free flow of water between adjacent cavities 518. Referring back to FIG. 16, the cavities 518 can have multiple variants. Different cube shapes and sizes are possible (e.g., crescent, cubical, hemispherical, cylindrical, star, moon, company logo, a combination of shapes and sizes simultaneously, etc.) as long as the ice pieces can be removed by the ice ejector 550, as described in detail below. In the embodiment shown, the plurality of cavities 518 are aligned in a lateral direction of the ice mold 510.

The bottom 514 of the ice mold 510 is contoured to receive the harvest heater 126 (FIG. 20), as described in detail above. The lateral sides 516 are contoured or sculpted to receive the ice maker evaporator (not shown), as described in detail above.

A recess 523 is formed in an upper edge of a wall 525 on a first end of the ice mold 510. In the embodiment illustrated, the recess 523 is arc-shaped. A wall 526 extends from a second, opposite end of the ice mold 510. One end of the wall 526 is contoured to define an inlet 528 to the ice mold 510. The inlet 528 extends directly to one cavity 518 and is free of intermediate steps or other features that may promote splashing as water flows from the inlet 528 to the cavity 518. A recess 532 is formed in an upper edge of the wall 526. A hole 534 extends through the wall 526 adjacent to the recess 532. The recess 532 is dimensioned and positioned to receive the ice stripper 540.

Two slots 536 are formed in an edge of one lateral side 516 of the ice mold 510. A corresponding tab 538 is positioned adjacent each slot 536. The slots 536 and tabs 538 are positioned and dimensioned to align with and engage mating features of the ice stripper 540, as described below.

It is contemplated that the ice mold 510, as described above, may reduce the amount of splashing of water during a fill process such that the lateral sides 516 of the ice mold 510 may be made shorter, as compared to conventional ice molds. The reduced height of the lateral sides 516 may reduce the material cost of the ice mold 510 and shorten manufacturing time.

Figure 17:
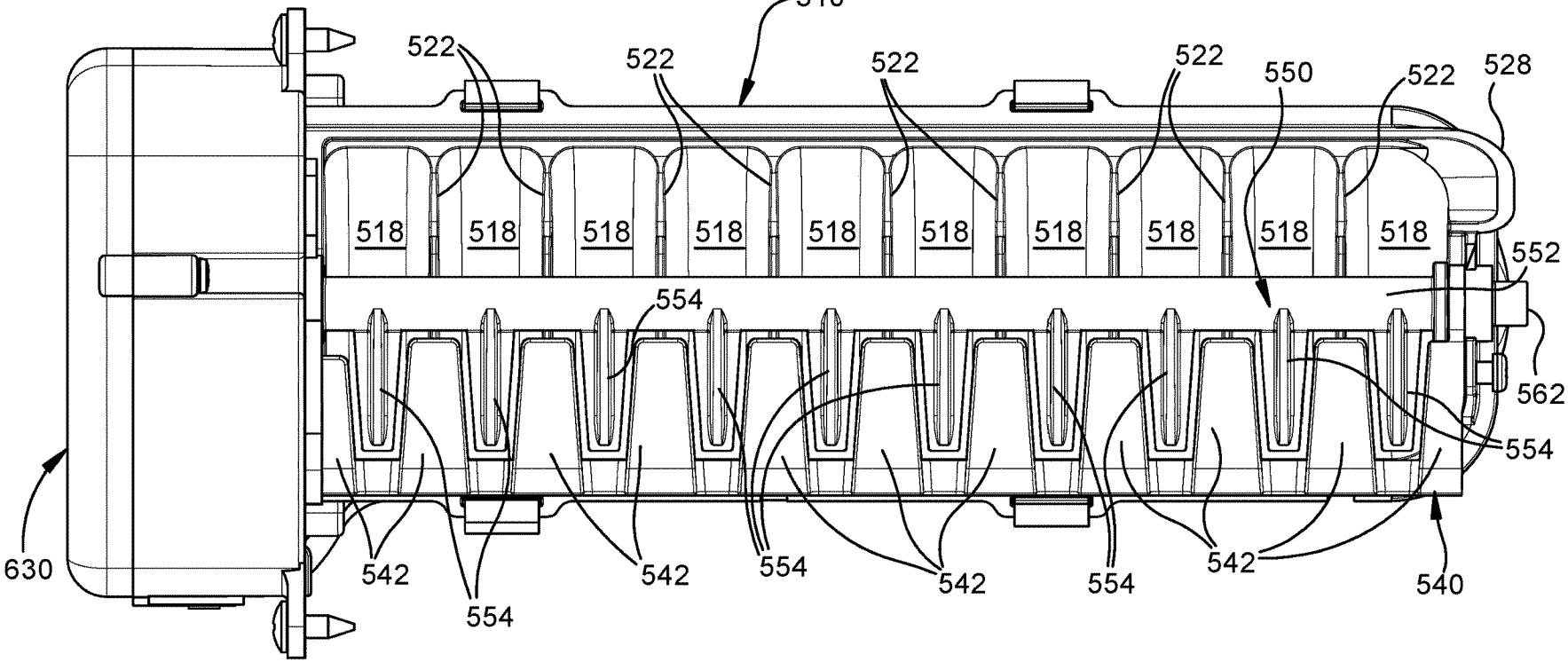
FIG. 17 is top view of the ice tray assembly of FIG. 15 with a cover of the ice tray assembly removed.
Figure 19:
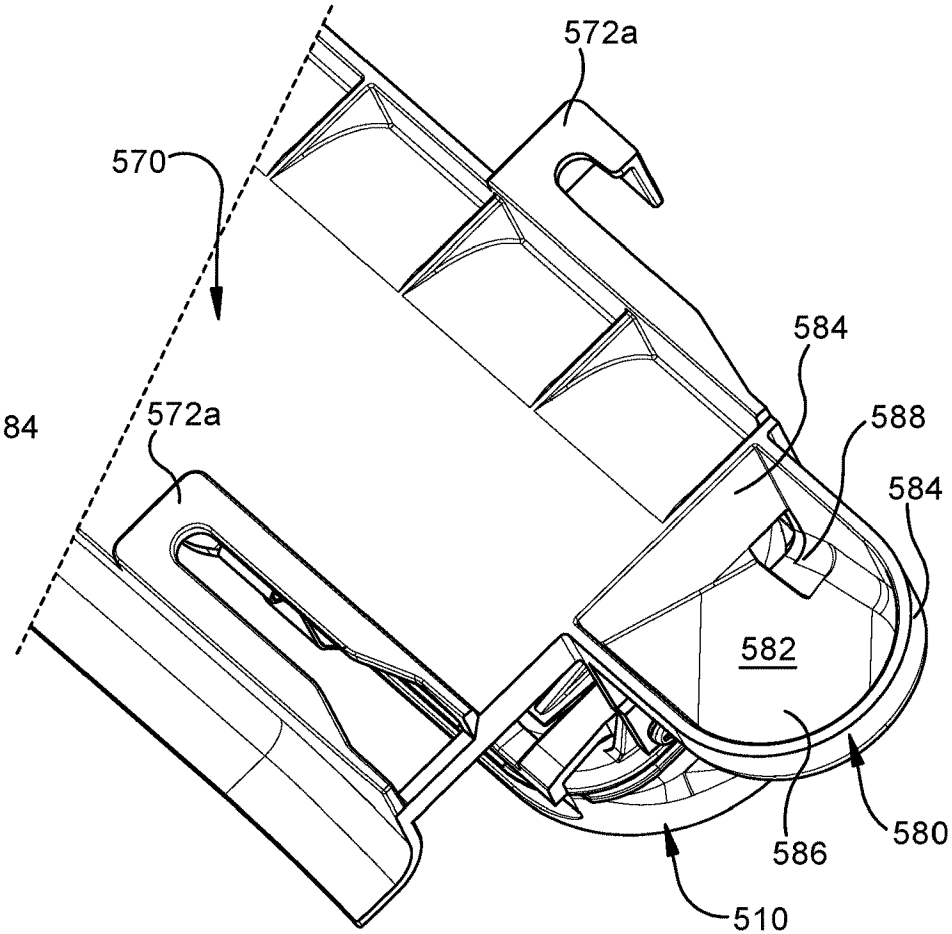
FIG. 19 is an enlarged top view of the end of one end of the ice tray assembly of FIG. 15.

The ice stripper 540 is an elongated element that includes a plurality of tabs 542 extending from one side of the ice stripper 540. Referring to FIG. 17, the tabs 542 are positioned and dimensioned to align with the weirs 522 of the ice mold 510 when the ice stripper 540 is secured to the ice mold 510. In particular, when the ice stripper 540 is attached to an upper end of one lateral side 516 of the ice mold 510, each tab 542 extends over a portion of a respective weir 522.

Referring to FIG. 16, a notch 543 may be formed between adjacent tabs 542. The notches 543 are configured to ease the removal of ice cubes from the ice mold 510 during a harvesting process. It is contemplated that the portion of the ice stripper 540 around the notch 543 may be reinforced to adjust for the loss in material from the notches 543.

Tabs 545 extend from the ice stripper 540 and are positioned and dimensioned to engage the slots 536 in the ice mold 510. In this respect, the tabs 545 and the slots 536 help to maintain the ice stripper 540 at the proper position, relative to the ice mold 510.

A support 544 is formed at an end of the ice stripper 540 that is received into the recess 532 of the ice mold 510. A hole 546 extends through a portion of the ice stripper 540 adjacent the support 544. The hole 546 is dimensioned and positioned to align with the hole 534 of the ice mold 510 when the support 544 is received into the recess 532 of the ice mold 510. The support 544 is dimensioned to allow the ice ejector 550 to rotate therein. The support 544 acts as a cylindrical bearing for allowing a matching portion of the ice ejector 550 to rotate therein.

The ice ejector 550, in general, is a rod-shaped element having a main body 552 with a plurality of arms 554 extending from the main body 552. The arms 554 are dimensioned and positioned as described in detail below.

A first end 556 of the ice ejector 550 is dimensioned to be received into a first opening 631*a* of the gear box 630 to allow the first end 556 to engage an output gear 658 (FIG. 24) inside the gear box 630, as described in detail below. The first end 556 rotates within the recess 523 in the ice mold 510. In this respect, the recess 523 in the ice mold 510 and the support 544 in the ice stripper 540 define bearing surfaces for allowing the ice ejector 550 to rotate about its longitudinal axis.

Referring to FIG. 17, the ice ejector 550 is positioned within the ice mold 510 and the ice stripper 540. The arms 554 of the ice ejector 550 are dimensioned and positioned to align with the spaces between the tabs 542 of the ice stripper 540 and the cavities 518 in the ice mold 510. As the ice ejector 550 rotates about its longitudinal axis that arms 554 move through the cavities 518 in the ice mold 510 to force ice pieces (not shown) out of the cavities 518.

Referring back to FIG. 16, a projection 562 extends from the second end 558 of the ice ejector 550. The projection 562 is fixed relative to the arms 554 for allowing a controller 800 (FIG. 15) to ascertain the orientation of the arms 554. It is contemplated that a sensor 555 (schematically shown in FIG. 15) may be positioned proximate the second end 558 of the ice ejector 550 for ascertaining the orientation of the projection 562. The controller 800 may be programmed such that, based on the detected orientation of the projection 562, the controller 800 may determine the position of the arms 554 relative to the cavities 518 of the ice mold 510. It is contemplated that the sensor 555 may be an optical sensor, a proximity sensor, a mechanical switch (e.g., a micro switch) or any other type of sensor that may be configured to determine the orientation of the projection 562. It is contemplated that orientation of the sensor 555 may be adjusted, as needed, during assembly.

In the embodiment shown, the projection 562 is generally D-shaped. It is contemplated that the projection 562 can have any other shape whose orientation changes when rotated, e.g., L-shaped, star-shaped, etc. It is further contemplated that, instead of the projection 562, a component 563, e.g., a magnet may be placed on the second end 558. As the ice ejector 550 rotates, the position of the component 563 will change and the sensor 555 may ascertain the new position of the component.

Figure 23:
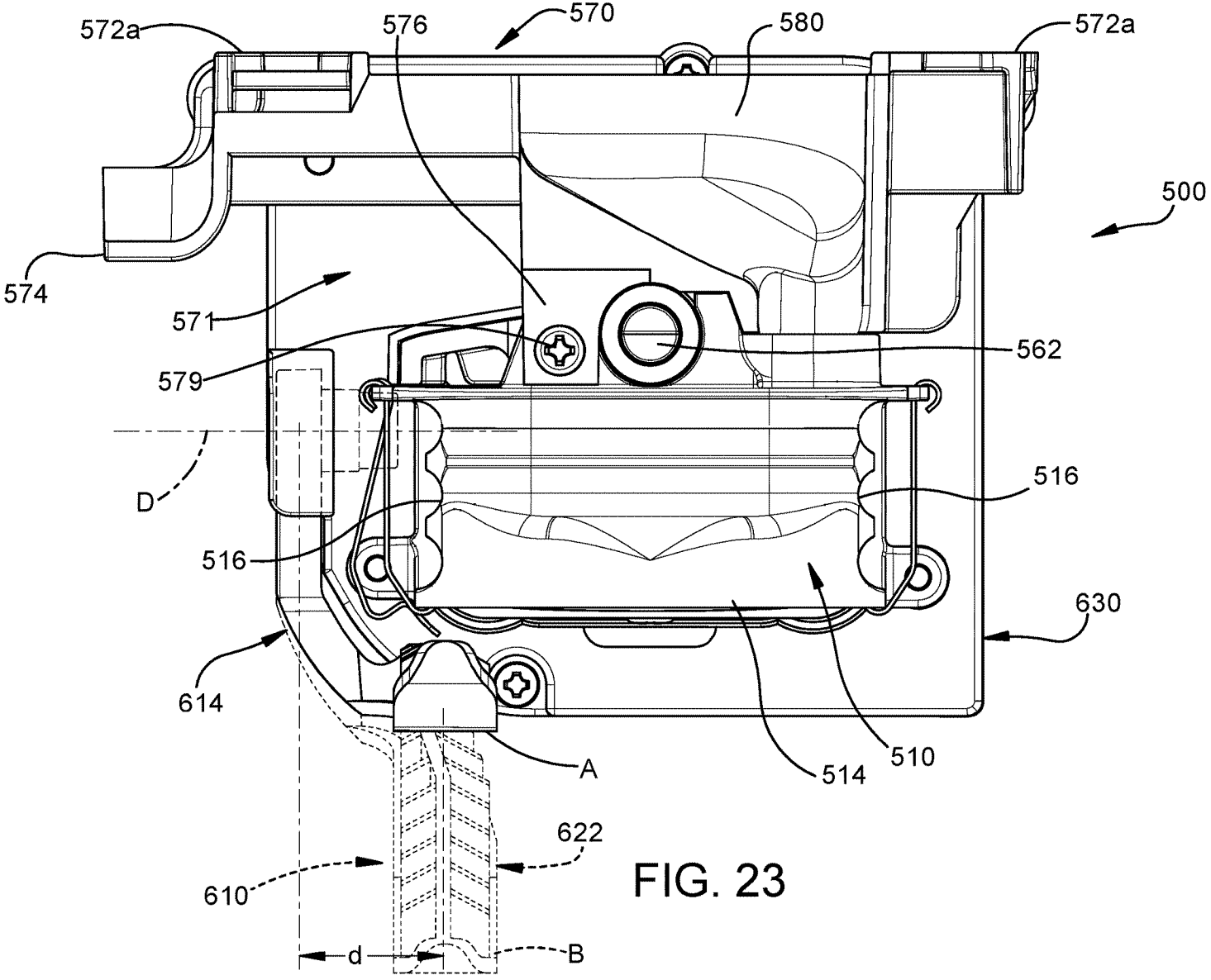
FIG. 23 is an end view of the ice tray assembly of FIG. 15 illustrating the bail arm in the both the first, upper position and the second, lower position.

The cover 570 is attached to the top 512 of the ice mold 510 for securing the ice tray assembly 500 to the frame or enclosure 52 which, in turn is attached to a liner of the fresh food compartment, as described in detail above regarding FIG. 3. The cover 570 may include slotted tabs 572*a*, 572*b* for securing the ice tray assembly 500 to mating features (not shown) in the liner. The length of an opening in the slotted tabs 572*a* is longer than an opening in the slotted tabs 572*b* such that, when the cover 570 is attached to the frame or enclosure 52, the mating features (e.g., shoulder screws (not shown)) first engage the slotted tabs 572*a* and then the slotted tabs 572*b*. In this respect, all four slotted tabs 572*a*, 572*b* do not have to be engaged initially at the same time, thereby easing assembly. One longitudinal edge 574 of the cover 570 is dimensioned to be spaced from the upper edge of the lateral side 516 of the ice mold 510 to define an opening 571 (FIG. 23). The opening 571 is dimensioned to allow the ice pieces in the ice mold 510 to be ejected from the ice tray assembly 500 when the ice ejector 550 rotates, as described in detail below.

Figure 18:
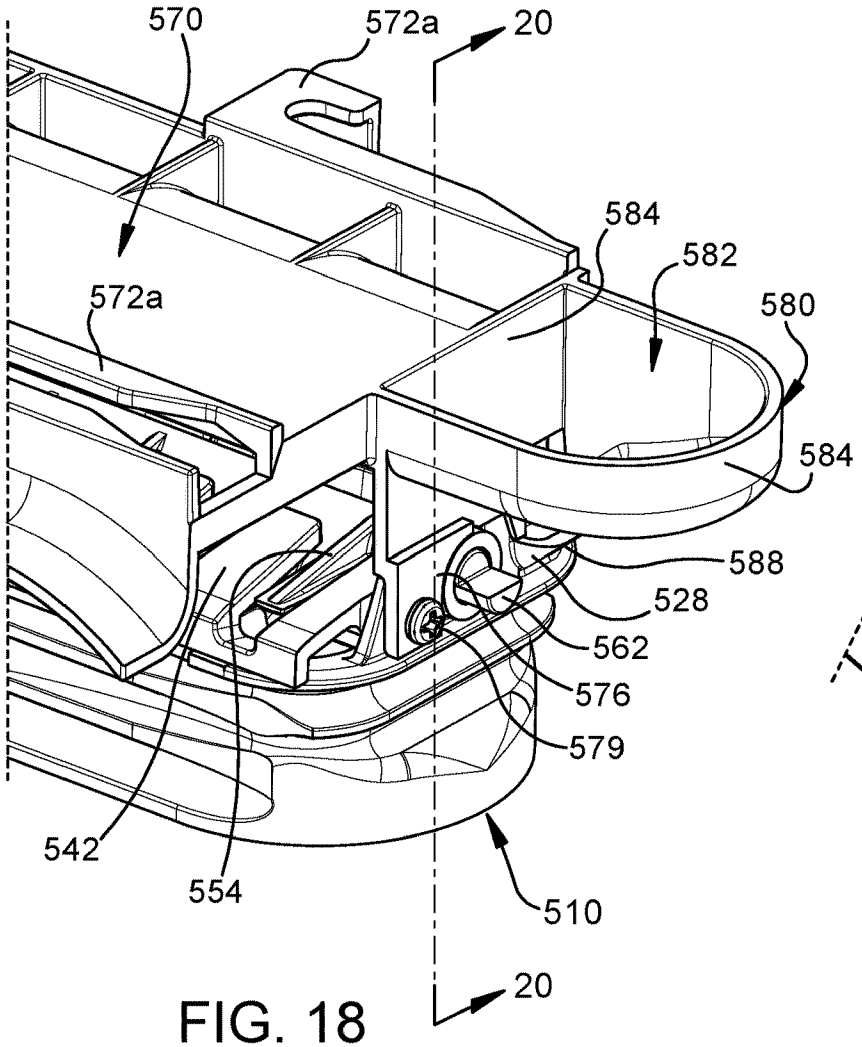
FIG. 18 is an enlarged view of one end of the ice tray assembly of FIG. 15.

In the embodiment shown in FIG. 18, a water fill cup 580 is integrally formed in one end of the cover 570. The water fill cup 580 has an open top 582 that is defined by walls 584. A bottom wall 586 (FIG. 19) of the water fill cup 580 is contoured to direct water to an outlet 588 of the water fill cup 580. The outlet 588 is dimensioned and position so that when the cover 570 is attached to the ice mold 510 the outlet 588 will align and mate with the inlet 528 formed in the wall 526 of the ice mold 510. As such, water injected into the water fill cup 580 will flow, by gravity to the cavities 518 in the ice mold 510. Alternatively, the water fill cup could be integrally formed together with the ice mold 510.

The cover 570 includes a downward projection 576 at one end of the cover 570. A hole 578 extends through the downward projection 576. Referring to FIG. 20, the hole 578 is dimensioned and positioned to align with the hole 546 in the ice stripper 540 and the hole 534 in the ice mold 510 when the cover 570 is secured to the ice mold 510. A fastener 579 extends through the holes 578, 546, 534 to align the cover 570, the ice ejector 550, and the ice stripper 540 to the ice mold 510. In particular, it is contemplated that the fastener 579 may extend through the hole 578 in the cover 570, the hole 534 in the ice mold 510 and the hole 546 in the ice stripper 540, in that order.

Referring to FIG. 16, a protrusion 612 extends from a distal end of the bail arm 610 and is dimensioned to a second opening 631*b* of the gear box 630. In the embodiment shown, the protrusion 612 is square-shaped. It is contemplated that the protrusion 612 may have other shapes, e.g., star, triangle, threaded, etc. so long as the protrusion 612 extends through the second opening 631*b*. It is contemplated that the second opening 631*b* may align with an opening 704 in a drive shaft 702 (FIG. 26) for allowing the drive shaft 702 to pivot the bail arm 610, as described in detail below.

Figure 21:
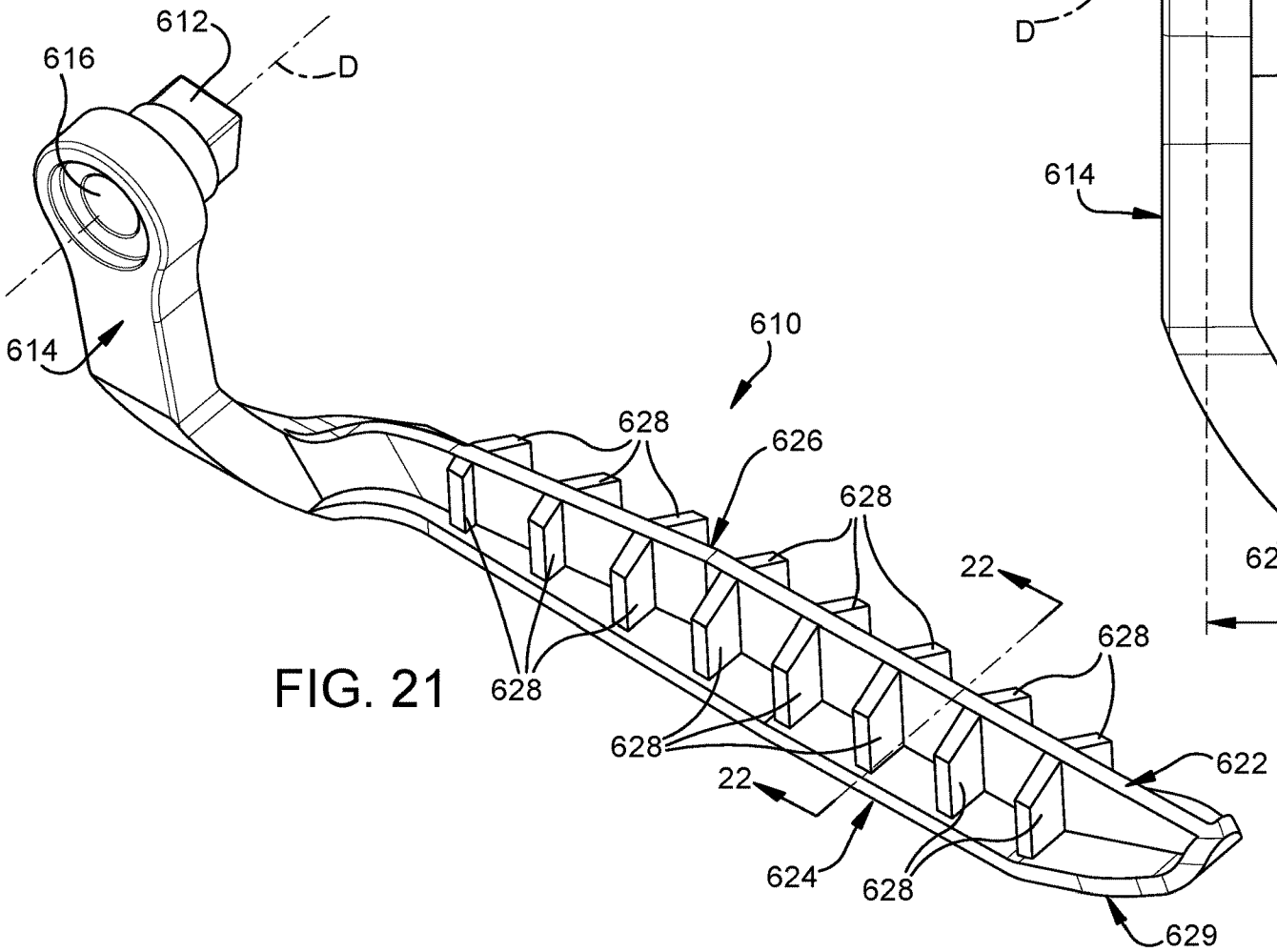
FIG. 21 is a side perspective view of the bail arm of the ice tray assembly of FIG. 15.

Referring to FIG. 21, the bail arm 610, in general, is an L-shape element having a first leg 614 and a second leg 622. The bail arm is used to detect the presence and the level of ice stored in the ice bin located next to the icemaker. The protrusion 612 is disposed at a distal end of the first leg 614 for engaging the gear box 630. A fastener (not shown) may extend through a hole 616 that extends through the protrusion 612 for securing the bail arm 610 to the gear box 630. The second leg 622 extends from an opposite end of the first leg 614.

The second leg 622, in general, has a T-shaped cross-section (see FIG. 22) and includes a base portion 624 and a leg portion 626. A plurality of spaced-apart ribs 628 are positioned between the base portion 624 and the leg portion 626. The plurality of spaced-apart ribs 628 may be contoured to be within a rectangular space C defined by the base portion 624 and the leg portion 626 (see FIG. 22). The spaced-apart ribs 628 may be configured to provide structural support to the bail arm 610. In the embodiment illustrated, the spaced-apart ribs 628 are aligned to be parallel to a pivot axis D (see FIGS. 15 and 21-23) of the bail arm 610. The pivot axis D is defined by the hole 616

A distal end of the second leg 622 is angled relative to the remaining portion of the second leg 622 to define an angled pad 629. It is contemplated that the angled pad 629 may be dimensioned and positioned to engage ice pieces that are disposed in the ice bin 54 (FIG. 3), as described in detail below. In the embodiment illustrated, the sides of the angled pad 629 are chamfered.

Figure 24:
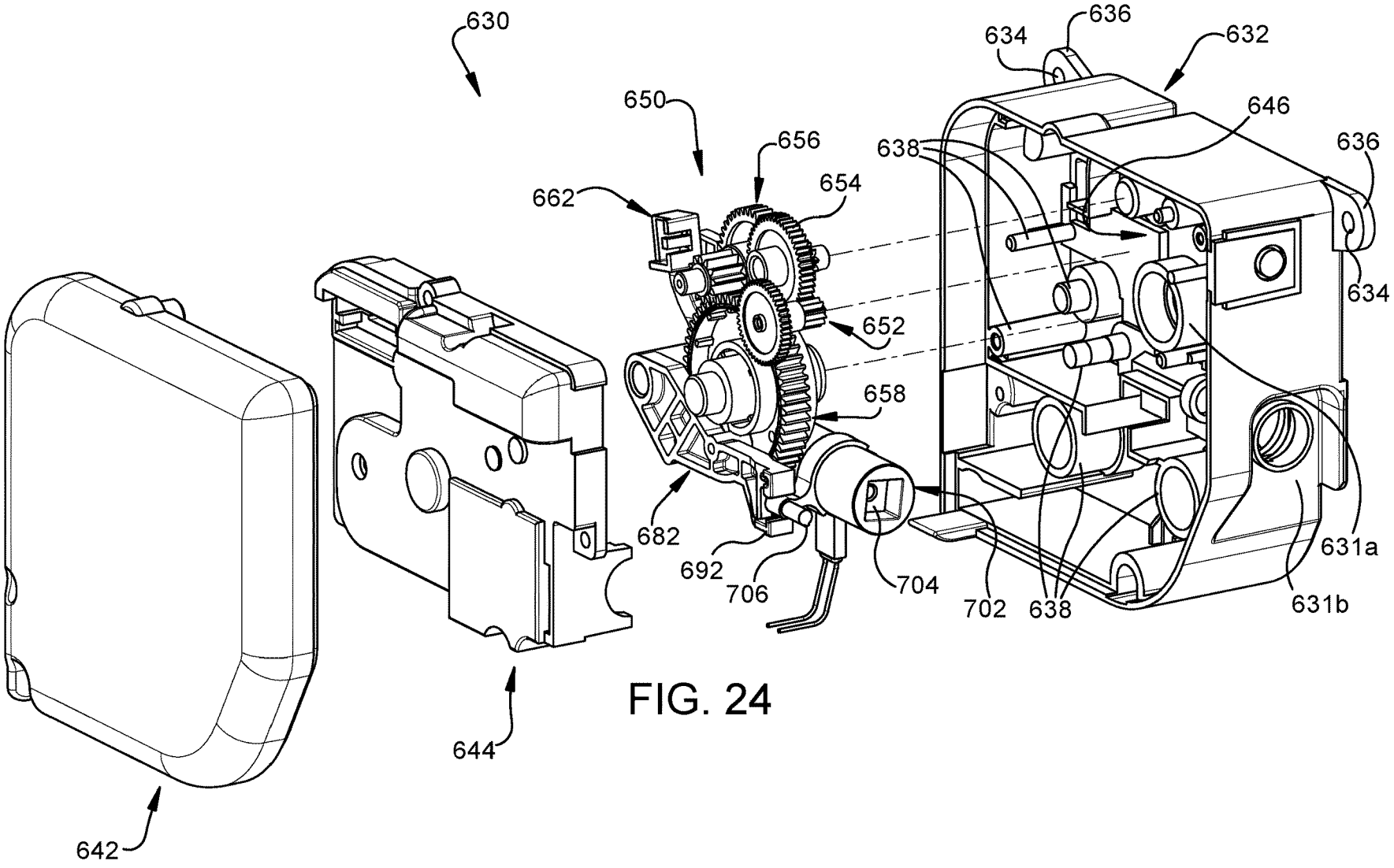
FIG. 24 is an exploded view of a gear box of FIG. 15.

Referring to FIG. 24, the gear box 630 includes a housing 632, a cover 642, an intermediate cover 644 and a gear mechanism assembly 650. The housing 632 includes two tabs 636 extending from opposite sides of the housing 632. A hole 634 extends through each tab 636 for receiving a fastener (e.g., a screw) for securing the gear box 630 to mounting holes (not shown) in the cover 570 (FIG. 15). The housing 632 may include other holes that receive fasteners for further securing the gear box 630 to the cover 570 and the ice mold 510.

A plurality of mounting posts 638 extend from an inner surface of the housing 632 for allowing various components to be mounted to the housing 632. In particular, the components are mounted to the plurality of mounting posts 638 to be stationary, pivotable or rotatable relative to the housing 632.

The cover 642 is attached to the housing 632 for closing an open end of the housing 632. A motor (not shown) and a drive gear (not shown) are disposed in an area 646 of the housing 632. The drive gear may be attached to an output shaft (not shown) of the motor for transferring rotational movement to the gear mechanism assembly 650. An intermediate cover 644 is disposed in the housing 632 and defines a chamber for receiving the gear mechanism assembly 650 and enclosing the area 646 wherein the motor (not shown) and the drive gear (not shown) are disposed.

Figure 26:
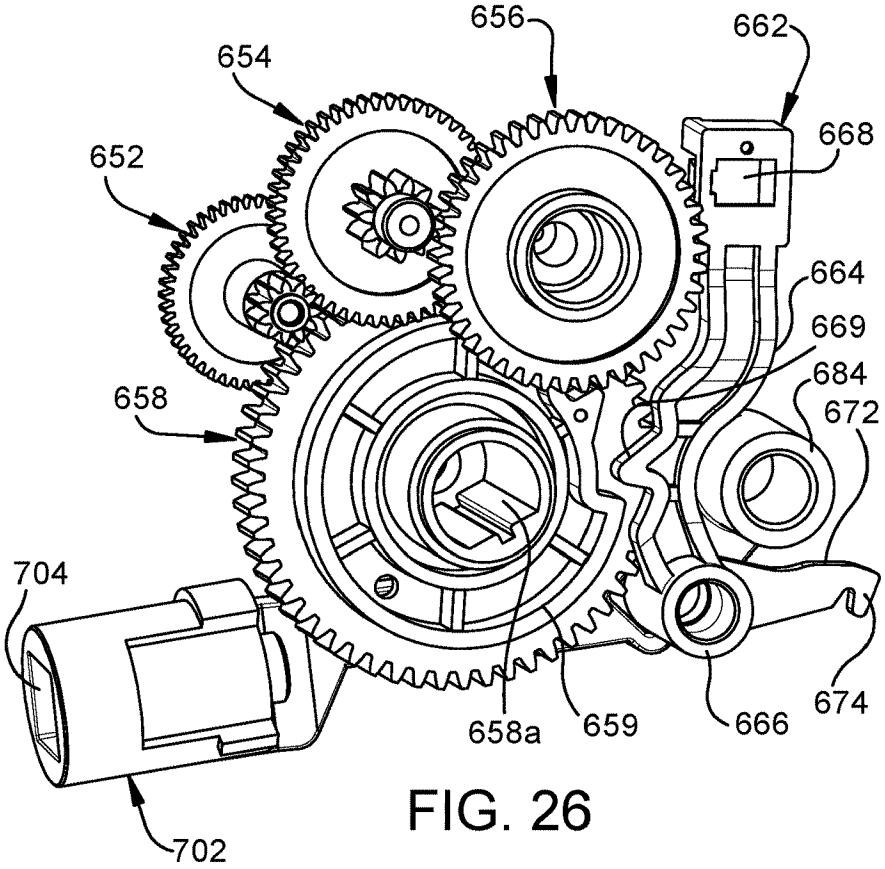
FIG. 26 is a rear perspective view of the gear mechanism assembly of FIG. 25.
Figure 25:
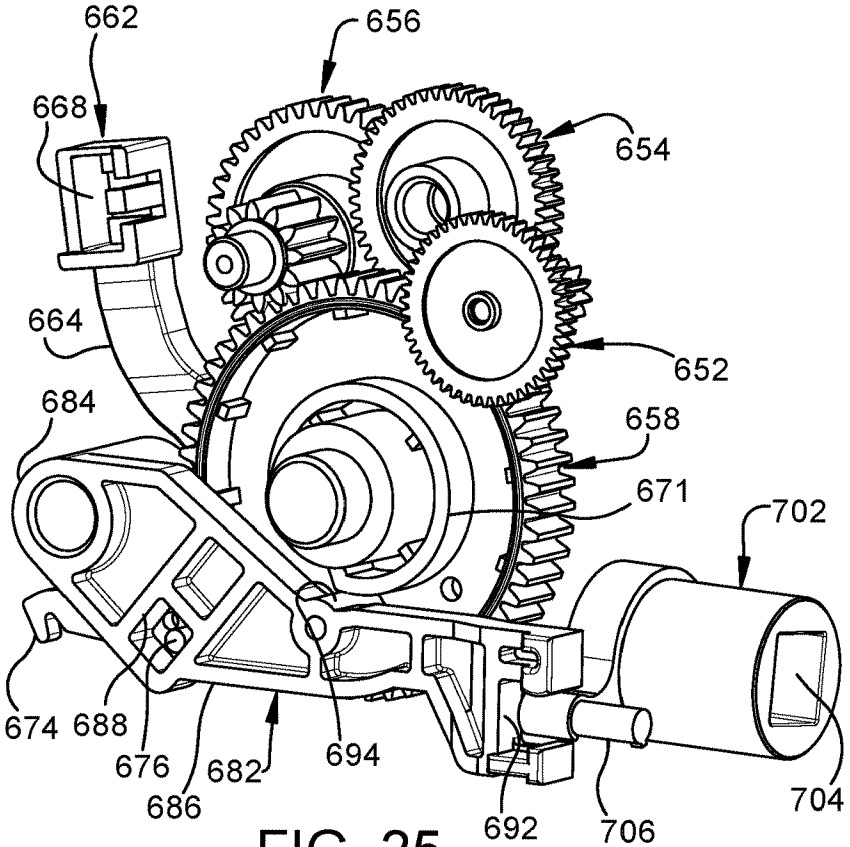
FIG. 25 is a front perspective view of a gear mechanism assembly of the gear box of FIG. 15.

Referring to FIGS. 25 and 26, the gear mechanism assembly 650 includes a first gear 652 that meshes with the drive gear (not shown) attached to the motor (not shown). The first gear 652 drives a first intermediate gear 654, which in turn drives a second intermediate gear 656. The second intermediate gear 656 drives an output gear 658. The output gear 658 includes an opening 658*a* that is dimensioned to align with the first opening 631*a* in the housing 632. The first end 556 of the ice ejector 550 (FIG. 16) extends through the first opening 631*a* and engages the opening 658*a* of the output gear 658. Via the first gear 652, the first and second intermediate gears 654, 656 and the output gear 658, rotation of the motor causes the ice ejector 550 to turn in the desired direction.

The gear mechanism assembly 650 also includes a first lever arm 662 that is pivotably attached inside the gear box 630. The first lever arm 662 includes a first leg 664 extending from a central pivot body 666 of the first lever arm 662. A pocket 668 is formed in a distal end of the first leg 664. The pocket 668 is dimensioned to receive a magnetic element (not shown). A protrusion 669 extends from a side of the first leg 664 and is positioned to engage a first cam 659 on one side of the output gear 658, as described in detail below.

A second leg 672 extends from the central pivot body 666 and includes a hook portion 674 configured to attach to a spring (not shown). The spring biases the first lever arm 662 into a first position, shown in FIGS. 27A, 27C, 28A, 28C. The first lever arm 662 also includes a post 676 (FIG. 25) that engages a pocket 688 formed in a second lever arm 682, as described in detail below.

The second lever arm 682 includes a central pivot body 684 and an arm portion 686 attached to the central pivot body 684. The pocket 688 is positioned and dimensioned to receive the post 676 of the first lever arm 662. A receiver 692 is formed at a distal end of the arm portion 686 for engaging a post 706 extending from a drive shaft 702, as described in detail below. A protrusion 694 extends from one side of the arm portion 686 and is positioned to engage a second cam 671 on a side of the output gear 658 opposite to the first cam 659.

The drive shaft 702 includes an opening 704 that is dimensioned to receive the protrusion 612 on the distal end of the bail arm 610. The opening 704 is positioned to align with the second opening 631*b* of the gear box 630 (FIG. 24) when the drive shaft 702 is positioned in the housing 632. The post 706 extending from the drive shaft 702 is dimensioned and positioned to be received into the receiver 692 of the second lever arm 682. The post 706 is attached to a spring (not shown) that biases the drive shaft 702 to a first rotated position corresponding to the bail arm 610 being in a second lower position B, as described in detail below.

Figure 27A:
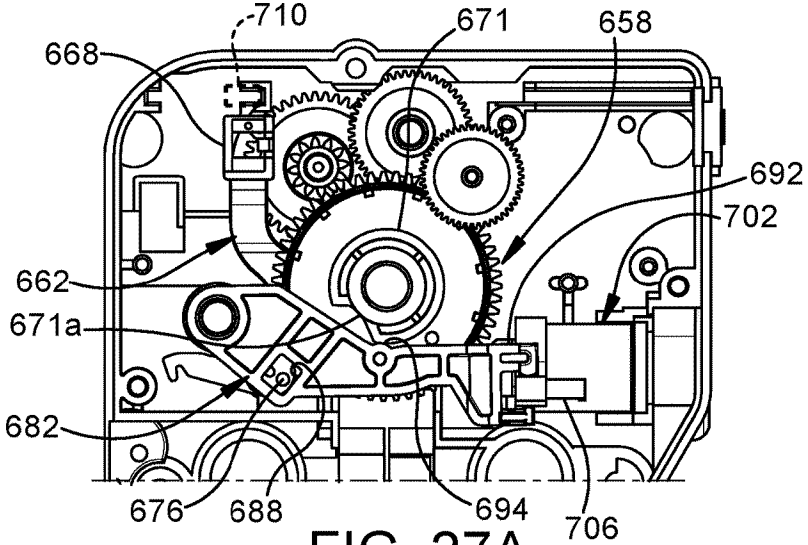
FIGS. 27A-27D are front views of the gear box of FIG. 24 with a cover and an intermediate cover removed, illustrating the gear mechanism assembly in various states of operation for determining a condition of an ice bin.
Figure 27B:
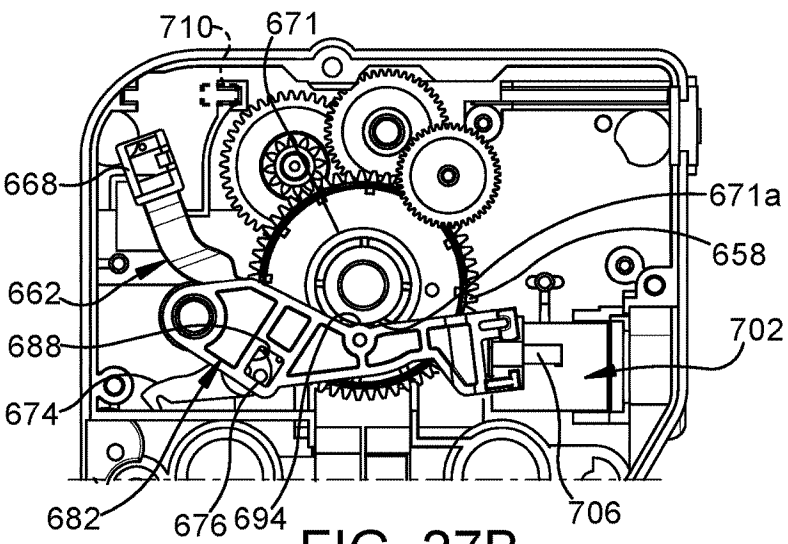
Figure 27C:
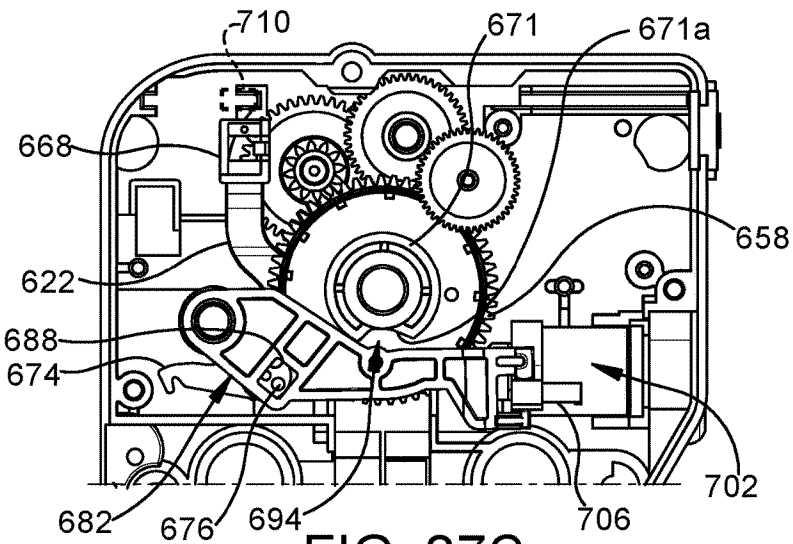
Figure 27D:
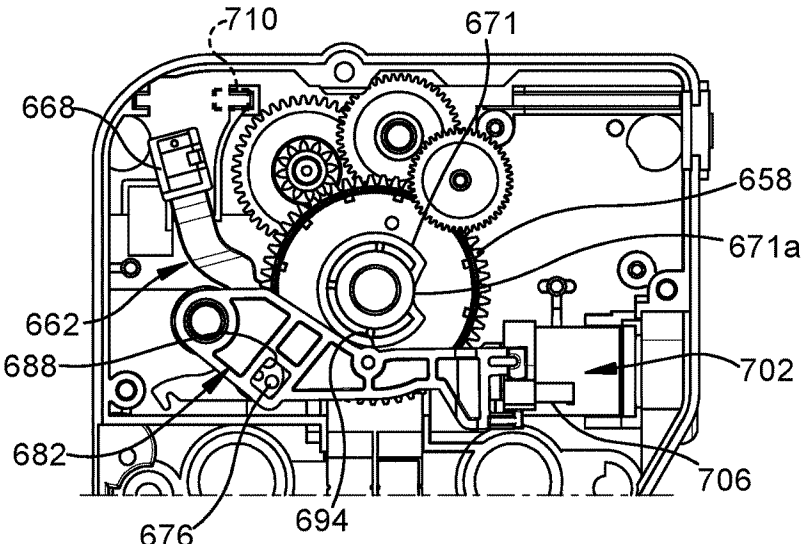

During operation of the ice tray assembly 500, the controller 800 may first actuate the bail arm 610 to determine whether ice needs to be added to the ice bin 54 (FIG. 3). To determine this, the controller 800 may energize the motor (not shown) in the gear box 630 to cause the bail arm 610 to pivot from a first upper position A to the second lower position B, as shown in FIGS. 15 and 23 about the pivot axis D. If the bail arm 610 contacts ice pieces prior to reaching the second lower position B (e.g., as determined by an increase in the power required to pivot the bail arm 610 or a combination of gears, linkages and sensors for determining when the bail arm 610 contacts ice pieces) the controller 800 may cause the bail arm 610 to be returned to the first upper position A. Accordingly, the controller 800 may then prevent the harvesting of ice pieces from the ice tray assembly 500 to the ice bin 54. However, if the bail arm 610 reaches the second lower position B without contacting ice pieces, then the controller 800 may cause the ice tray assembly 500 to harvest ice pieces into the ice bin 54 (FIG. 3). As noted above, the side of the angled pad 629 are chamfered. This chamfer helps to reduce the risk that the bail arm 610 may be damaged if a user removes the ice bin 54 when the bail arm 610 is in the second lower position B. According to one aspect, the controller 800 may control the gear box 630 in the following manner to detect whether the ice bin 54 is full or empty. Referring to FIGS. 27A-27B, the gear box 630 includes a hall sensor 710 that may be mounted to a printed circuit board (PCB) (not shown) that is disposed in the housing 632.

Figure 28A:
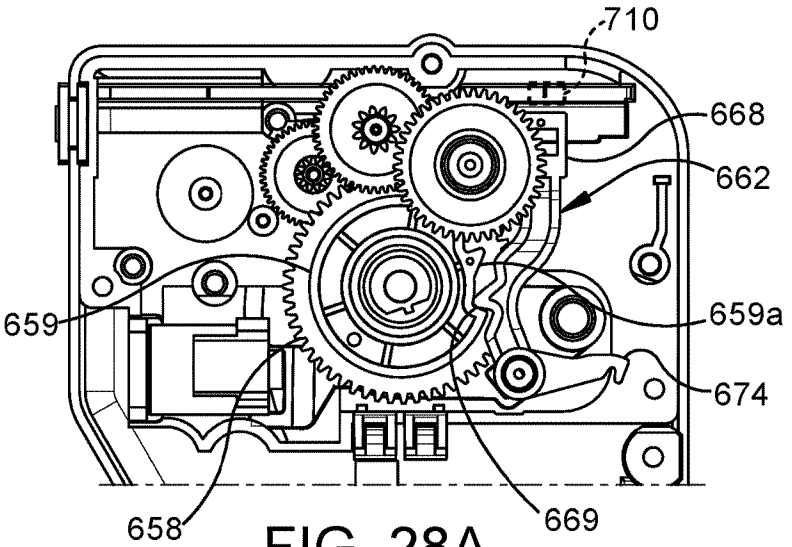
FIGS. 28A-28D is a rear view of the gear box of FIG. 25 with a housing removed, illustrating the gear mechanism assembly in various states of operation for determining a condition of an ice bin.

Referring to FIGS. 27A and 28A, the first and second lever arms 662, 682 are shown in a first position, as referred to as a "home" position. In this first position, the spring (not shown) attached to the hook portion 674 of the first lever arm 662 biases the distal end of the first lever arm 662 (which includes the pocket 668 for receiving the magnetic element (not shown)) to a first position adjacent the hall sensor 710. When the magnetic element is positioned adjacent the hall sensor 710, the hall sensor 710 provides a signal indicative of "LOW" to the controller 800. Further, the first lever arm 662 is allowed into the first position because the protrusion 669 on the first lever arm 662 is received into a recess 659*a* of the first cam 659 on the output gear 658.

In addition, the protrusion 694 on the second lever arm 682 engages the second cam 671 on the output gear 658 such that the second lever arm 682 is in the first position. When in the first position, the second lever arm 682 is pivoted downward (relative to FIG. 27A) such that the drive shaft 702 is positioned in a second rotated position that corresponds to the bail arm 610 being in the upper position A (FIG. 15).

Figure 28B:
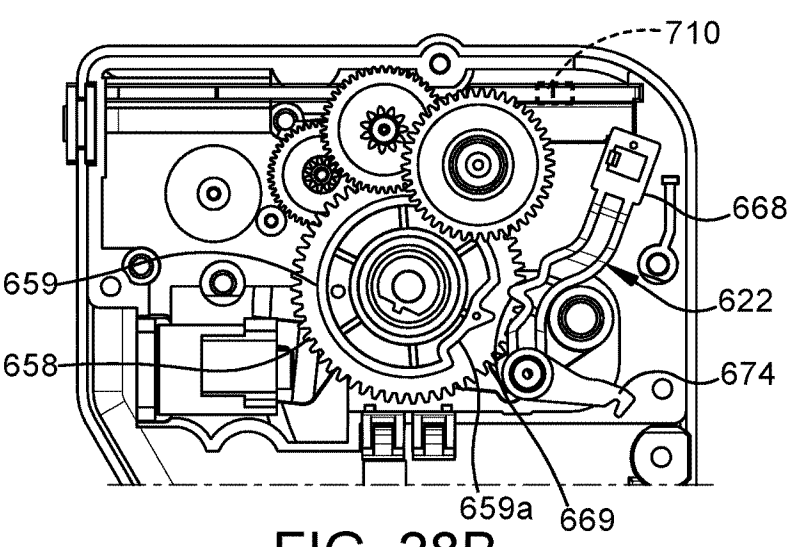

As the output gear 658 rotates in the counter clock-wise direction (with reference to FIGS. 27A-27D) the output gear 658 is eventually positioned such that the protrusion 694 on the second lever arm 682 aligns with a recess 671*a* in the second cam 671. In this position, the spring (not shown) attached to the post 706 of the second lever arm 682 causes the drive shaft 702 to rotate the bail arm 610 from the first upper position A toward the second lower position B. If the bail arm 610 is able to reach the second lower position B, then the first lever arm 662 and the second lever arm 682 will be positioned as shown in FIGS. 27B and 28B. In particular, the protrusion 694 on the second lever arm 682 will bottom out in the recess 671*a* so that the second lever arm 682 pivots to a second position. As the second lever arm 682 pivots, the pocket 688 in the second lever arm 682 will engage the post 676 on the first lever arm 662 and cause the first lever arm 662 to pivot to a second position. In the second position, the pocket 668 (and the magnetic element therein) in the first lever arm 662 are positioned away from the hall sensor 710. When the magnetic element is positioned away from the hall sensor 710, the hall sensor 710 will send a signal indicative of "HIGH" to the controller 800.

Figure 28C:
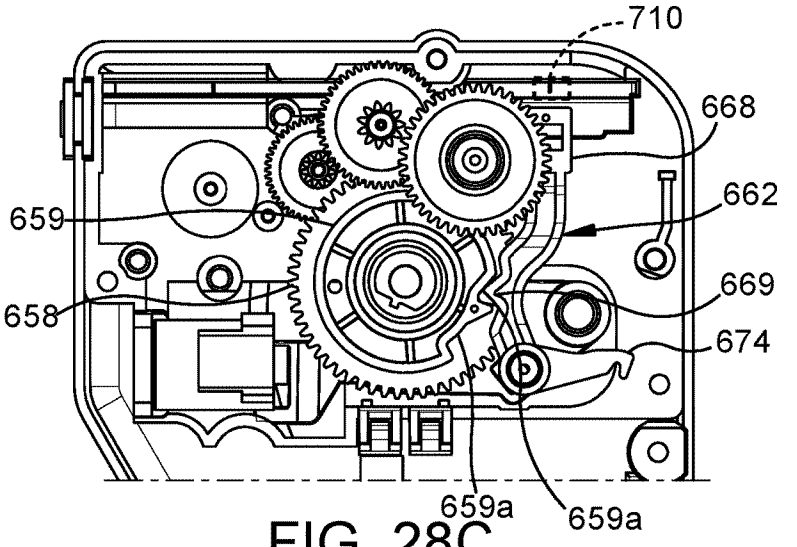
Figure 28D:
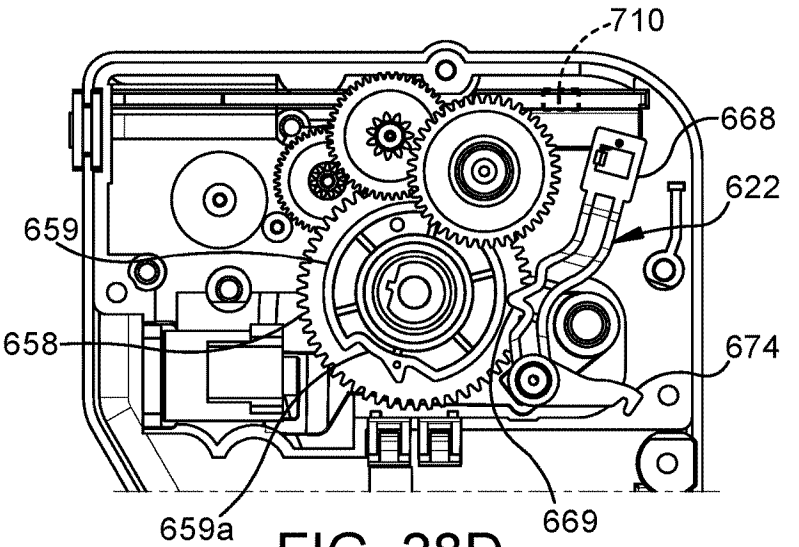

In contrast, if the bail arm 610 is not able to reach the second lower position B, e.g., it contacts ice pieces in the ice bin 54, then the protrusion 694 will not bottom-out in the recess 671*a* and the second lever arm 682 will remain in the first position. See FIGS. 27C and 27B. In this position the pocket 668 (and the magnetic element therein) will remain adjacent the hall sensor 710 and the hall sensor 710 will send a signal indicative of "LOW" to the controller 800. As illustrated in FIG. 28C, the protrusion 669 on the first lever arm 662 will be positioned in the recess 659*a* such that the first lever arm 662 will remain in the first position.

As the output gear 658 continues to rotate in the counter clock-wise direction (with reference to FIGS. 27A-27D), the protrusion 694 of the second lever arm 682 will continue to ride on the second cam 671 and maintain the second lever arm 682 in the first position and the bail arm in the first upper position A. The protrusion 669 on the first lever arm 662 will ride on the first cam 659 and cause the first lever arm 662 to pivot to the second position. In this second position the pocket 668 (and the magnetic element therein) will pivot away from the hall sensor 710. When the magnetic element is moved from the hall sensor 710, the hall sensor 710 will send a signal indicative of "HIGH" to the controller 800.

As described above, as the output gear 658 rotates in the counter clock-wise direction (with reference to FIGS. 27A-27D), the signal from the hall sensor 710 will change between HIGH and LOW based on whether the ice bin 54 is full or less than full. In particular, the sequence of the changes between HIGH and LOW will depend on whether the ice bin 54 is full or less than full. The controller 800 is programmed such that, based on the sequence of changes the controller 800 is able to determine whether the ice bin 54 is full or less than full. The present invention provides a gear box 630 that is configured to determine a condition of an ice bin 54, i.e., full or less than full, using a single sensor. Conventional methods require multiple sensors to determine the condition of an ice bin.

If the ice bin 54 is less than full, the ice pieces are harvested from the ice mold 510. In particular, the motor associated with the gear box 630 may cause the ice ejector 550 to rotate such that the arms 554 move through the cavities 518. As the arms 554 move through the cavities 518, they force the ice pieces in the cavities 518 out of the ice mold 510. When viewed from the end of the ice tray assembly 500 opposite the gear box 630 (see FIG. 23), the ice ejector 550 is rotatable in a counter-clockwise direction such that the ice ejector 550 forces the ice pieces into an area above the ice mold 510. A lower surface of the cover 570 is curved to direct the ice pieces toward the opening 571 between the cover 570 and the ice mold 510. As the ice ejector 550 continues to rotate, the ice pieces are then ejected from the ice tray assembly 500 into the ice bin 54 (FIG. 3) positioned below the ice tray assembly 500.

Figure 22:
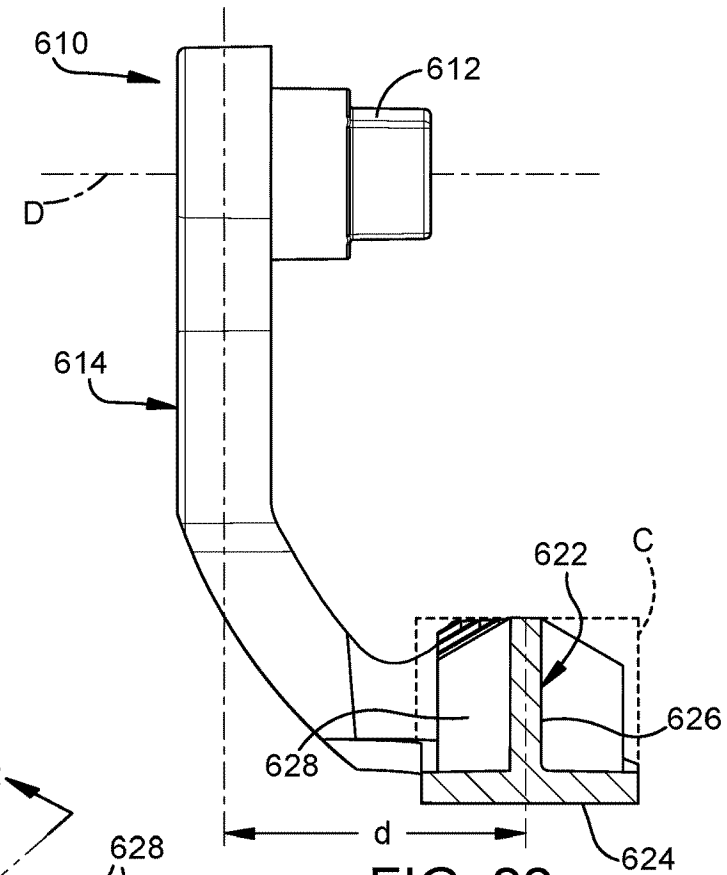
FIG. 22 is a section view taken along lines 22-22 of FIG. 21.

Referring to FIG. 23, during the ejection of the ice pieces from the ice mold 510, the bail arm 610 is in the first upper position A. In particular, the first leg 614 is positioned adjacent a side of the gear box 630 and the second leg 622 is positioned underneath the ice mold 510. The ice mold 510 functions as a shield to prevent the ice pieces from striking the second leg 622 of the bail arm 610 as the ice pieces fall toward the ice bin 54 (FIG. 3). A separate shield or plate to protect the second leg 622 of the bail arm 610 from falling ice pieces is not required. Moreover, by placing the second leg 622 of the bail arm 610 below the ice mold 510 during ejection of the ice pieces, the likelihood that the ice pieces will become lodged or jammed in the bail arm 610 or between the bail arm 610 and the ice mold 510 is reduced. Further, as illustrated in FIGS. 21-23, relative to the pivot axis D (see FIGS. 15 and 21-23) for the bail arm 610, the first leg 614 and the second leg 622 are offset from each other a distance d (see FIGS. 22 and 23). It is contemplated that the offset may allow the first leg 614 to be maintained in close proximity to the side of the gear box 630 while the second leg 622 is maintained underneath the ice mold 510 during pivoting of the bail arm 610. The distance d may be between about 15 and 25 mm, preferably about 19.5 mm.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A refrigeration appliance comprising:

a fresh food compartment for storing food items in a refrigerated environment having a target temperature above 0° C.;

a freezer compartment for storing food items in a sub-freezing environment having a target temperature below 0° C.;

a system evaporator for providing a cooling effect to at least one of the fresh food compartment and the freezer compartment; and an ice tray assembly disposed within the fresh food compartment for freezing water into ice pieces, the ice tray assembly comprising:

an ice mold with an upper surface comprising a plurality of cavities formed therein for the ice pieces, a heater disposed on the ice mold;

an ice maker refrigerant tube abutting at least one lateral side surface of the ice mold and cooling the ice mold to a temperature below 0° C. via thermal conduction; and a bail arm attached to a gear box of the ice tray assembly, the bail arm pivotable between an upper position and a lower position, wherein the bail arm is L-shaped with a first leg attached to the gear box and a second leg extending from the first leg, the first leg offset from the second leg relative to a pivot axis of the bail arm and the second leg moving in a vertical plane that is a fixed distance from a vertical plane that the first leg moves in as the bail arm pivots between the upper position and the lower position, wherein at the upper position the second leg of the bail arm extends directly into a vertical projection of an area covered by a lower surface of the ice mold and substantially parallel to the lower surface of the ice mold, wherein at the lower position the second leg of the bail arm extends directly into the vertical projection of the area covered by the lower surface of the ice mold and skewed downward relative to the lower surface of the ice mold, and wherein a distal end of the bail arm remains in the vertical projection of the area covered by the lower surface of the ice mold when the bail arm pivots between the upper position and the lower position.

2. The refrigeration appliance of claim 1, wherein the second leg includes a plurality of spaced-apart reinforcing ribs.

3. The refrigeration appliance of claim 1, further comprising a cover having a water fill cup integrated into the cover and an outlet aligned with an inlet of the ice mold.

4. The refrigeration appliance of claim 3, wherein the cover and the ice mold are configured to capture a support bearing for an ice ejector therebetween and wherein the support bearing is part of an ice stripper of the ice tray assembly.

5. The refrigeration appliance of claim 4, further comprising a sensor for detecting an angular position of the ice ejector.

6. The refrigeration appliance of claim 5, wherein the sensor is configured to detect an angular position of a feature of the ice ejector.

7. The refrigeration appliance of claim 6, wherein the feature is a contoured shape formed on a distal end of the ice ejector.

8. The refrigeration appliance of claim 1, wherein the gear box includes a single sensor for determining the condition of an ice bin disposed below the ice mold.

9. The refrigeration appliance of claim 8, further comprising a controller programmed to determine the condition of the ice bin based on a sequence of signals received from the single sensor.

* * * * *